US006340790B1

(12) United States Patent
Gordin et al.

(10) Patent No.: US 6,340,790 B1
(45) **Date of Patent: *Jan. 22, 2002**

(54) MEANS AND METHOD FOR INTEGRATED LIGHTING FIXTURE SUPPORTS AND COMPONENTS

(75) Inventors: Myron K. Gordin; James L. Drost, both of Oskaloosa, IA (US)

(73) Assignee: Musco Corporation, Oskaloosa, IA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/967,579

(22) Filed: Nov. 1, 1997

Related U.S. Application Data

(63) Continuation of application No. 08/791,641, filed on Jan. 28, 1997, now abandoned, which is a continuation of application No. 08/278,999, filed on Jul. 22, 1994, now abandoned, which is a continuation of application No. 07/652,557, filed on Feb. 6, 1991, now abandoned, which is a continuation-in-part of application No. 07/472,822, filed on Jan. 31, 1990.

(51) Int. Cl.[7] ..... E04H 12/24

(52) U.S. Cl. ..... 174/45 R; 174/45 R; 362/249; 362/396; 362/431; 405/232

(58) Field of Search ..... 174/45 R; 362/249, 362/396, 431, 432; 405/232

(56) References Cited

U.S. PATENT DOCUMENTS

| | | | | |
|---|---|---|---|---|
| 595,600 | A | 12/1897 | Buck | |
| 732,223 | A | 6/1903 | Rhoades | 33/375 |
| 2,036,771 | A | 4/1936 | Pfistershammer | 189/26 |

(List continued on next page.)

FOREIGN PATENT DOCUMENTS

| | | | | |
|---|---|---|---|---|
| DE | 705891 | 3/1954 | | |
| DE | 2255713 | 11/1972 | | E04H/12/34 |
| DE | 3440531 C1 | 2/1984 | | E04H/12/22 |

(List continued on next page.)

OTHER PUBLICATIONS

Centrecon Sportsliner II–50 (Brochure)(Prior to Feb. 6, 1991) 4 Pages.

Centrecon, Inc., FL Series FloodLighting (Brochure) (Prior To Feb. 6, 1991) 2 Pages.

*Primary Examiner*—Albert W. Paladini
(74) *Attorney, Agent, or Firm*—Zarley, McKee, Thomte, Voorhees & Sease

(57) ABSTRACT

A device and method for rigidly elevating a structure includes a base member securable in the ground and which has a portion extending above the ground. A pole section, having a bore inside a lower end, and an upper end, can be stacked upon the base member upwardly by slip fitting the pole section onto the base end and securing it in place. A flexible, easily transportable and durable system is thereby created for elevating structures. An integrated pole for elevating light fixtures and all other necessary components such as electrical components, can be predesigned, shipped, and easily installed at a desired location. A pole top member, including rigidly secured cross arms, can be inserted on the top of a pole. All wiring for both the pole top cross arms, and the pole itself can be preconfigured and require simple connection of plugs between wiring segments. Additional features can include ballast boxes which quickly attach to the pole by easy mounting brackets, and which also allow communication with the interior of the pole to allow easy electrical connection of its components. Still further, the wiring can be protected and reliably secured in the pole by structure and methods which deter abrasion or slippage. The entire assembly can be shipped and quickly and easily assembled on site without intensive labor, equipment, or cost.

20 Claims, 14 Drawing Sheets

U.S. PATENT DOCUMENTS

| | | | | | |
|---|---|---|---|---|---|
| 3,713,262 | A | | 1/1973 | Jatcko | 52/296 |
| 3,865,498 | A | | 2/1975 | Okuto et al. | 403/292 |
| 3,958,381 | A | | 5/1976 | Meyer | 52/303 |
| 3,991,532 | A | | 11/1976 | Buxbom | 52/297 |
| 4,033,080 | A | | 7/1977 | Fukushima | 52/223 |
| 4,092,079 | A | | 5/1978 | Swanson | 403/306 |
| 4,190,881 | A | * | 2/1980 | Drost et al. | 362/431 X |
| 4,246,732 | A | | 1/1981 | Frehner | 52/309 |
| 4,617,768 | A | | 10/1986 | Gebelius | 52/40 |
| 4,673,157 | A | | 6/1987 | Wells | 249/13 |
| 4,779,389 | A | | 10/1988 | Landers | 52/169.13 |
| 4,878,160 | A | * | 10/1989 | Reneau et al. | 362/431 |
| 4,894,759 | A | * | 1/1990 | Siems | 362/431 X |

FOREIGN PATENT DOCUMENTS

| | | | |
|---|---|---|---|
| DE | 3440531 | 3/1986 | |
| FR | 876891 | 11/1941 | 52/208 |
| FR | 253780 | 11/1982 | E04H/12/22 |
| FR | 2536780 | 11/1982 | |
| GB | 426074 | 3/1935 | |
| GB | 717699 | 11/1951 | |

* cited by examiner

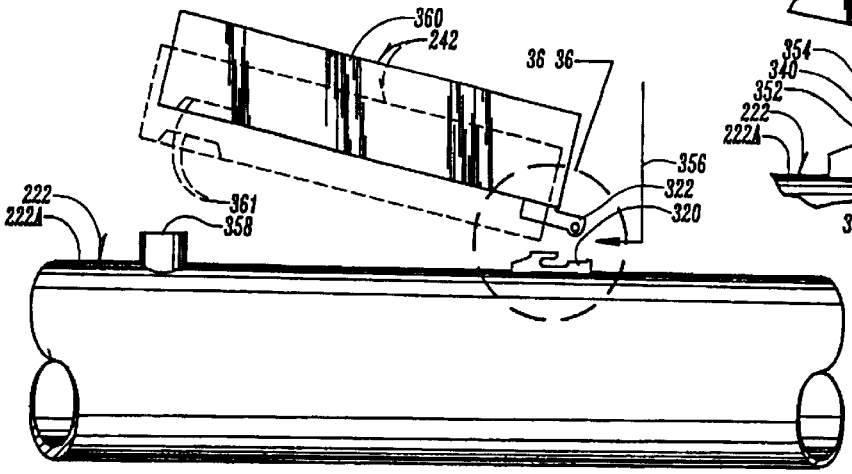
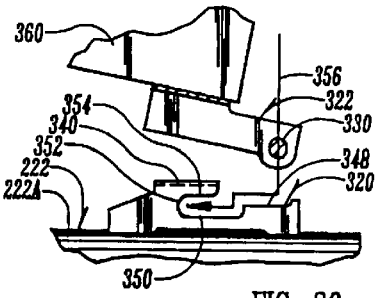
FIG. 36
FIG. 35
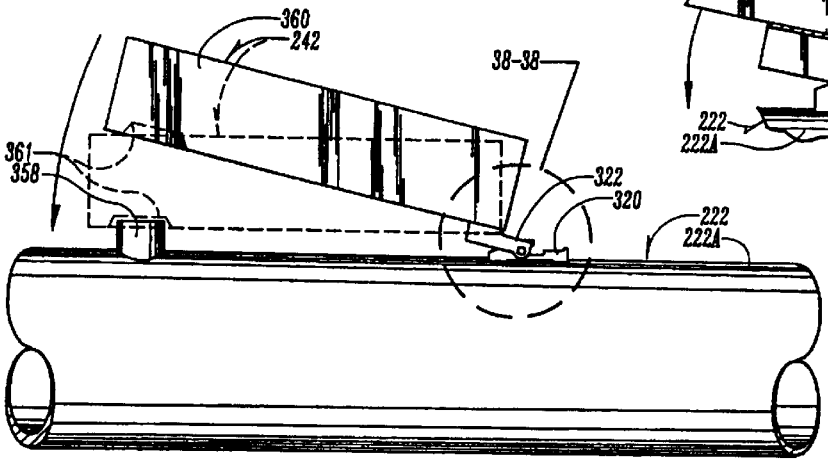
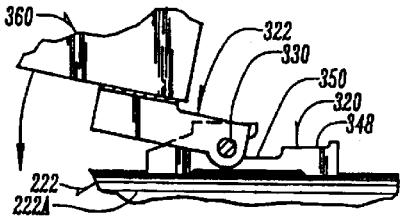
FIG. 38
FIG. 37
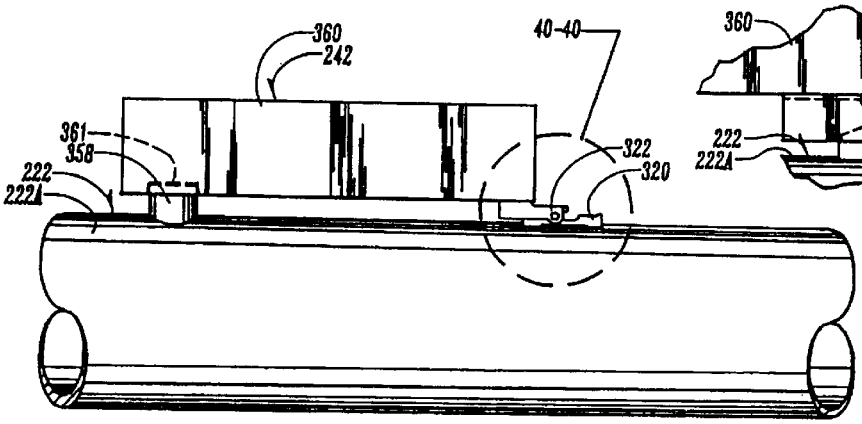
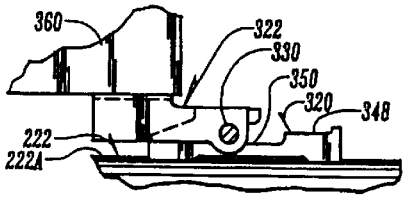
FIG. 40
FIG. 39

MEANS AND METHOD FOR INTEGRATED LIGHTING FIXTURE SUPPORTS AND COMPONENTS

RELATED APPLICATION

This application is a Con of Ser. No. 08/791,641 filed Jan. 28, 1997 abandoned which is a Con of Ser. No. 08/278,999 filed Jul. 22, 1994 abandoned which is a Con of Ser. No. 07/652,557 filed Feb. 6, 1991 abn which is a continuation-in-part application from U.S. Ser. No. 07/472,822, filed Jan. 31, 1990, by Gordin and Drost.

BACKGROUND OF THE INVENTION

1. Field of the Invention

The present invention relates to a means and methods for elevating structures, and in particular, to poles anchored in the ground for vertically elevating any type of member or members to an extended distance.

This invention further relates to installation of lighting fixtures in a position elevated above the ground on poles, and in particular, the comprehensive integrated combination of fixture supports and poles, wiring, and electrical components to operate the lighting fixtures.

2. Problems in the Art

A number of structures or things must be suspended from the ground. Examples are light fixtures, sirens, antennas, wires, and the like. Many times these structures need to be rigidly supported. Of course, a conventional means to accomplish this is to utilize an elongated pole.

Commonly known examples of poles of this type are telephone poles, electrical wire poles, light poles, sign poles, and utility poles. Most of these types of poles are anchored in the ground and extend vertically upward to many times tens of feet in height.

The widespread utilization of these types of poles is indicative of the preference to utilize elongated structures or poles to elevate objects in the air. For whatever reasons, whether it be economical or practical, the demand for the poles is very high for a number of different uses.

Poles of this nature can be made of a number of materials and can be erected and installed in a number of ways. While each of the commonly used poles achieves the end result of elevating objects in the air, the different types commonly used have both their advantages and disadvantages.

Wood poles represent the longest used and still today the many times preferred type of pole. They are relatively inexpensive, have a good height to diameter strength ratio, and can be rather easily adapted for a number of uses.

Problems and disadvantages of wood poles, however, are at least:

a. Difficult to find straight wood poles, especially for taller heights;

b. Natural processes decay or at least weaken wood;

c. Wood is fairly heavy;

d. Pole comes in single long length which can be difficult to transport;

e. Environmental problems associated with using trees could effect availability;

f. Appearance;

g. Uncertainty of strength;

h. Bottom end is buried in the ground and therefore even more susceptible to decay and deterioration; and i. Difficulties in providing adequate foundation and support for the pole.

Wood, therefore, may represent a cheaper, more available source for at least shorter poles, but is not the preferred type of pole because of, in significant part, some of the above mentioned problems.

An alternative pole that has more recently been utilized is one made substantially of concrete. For even significantly tall poles, concrete has great strength in compression and with a steel cable infra structure offers strength in tension. With advances in the nature of concrete, such poles offer a relatively economical and very strong alternative to wood.

Disadvantages of concrete are at least the following, however:

a. Very heavy, even with a hollow core (may not be able to make very long);

b. Require a big crane or other power means to lift them which is expensive;

c. The weight tends to cause them to shift when positioned in the ground;

d. It is somewhat difficult to form holes or otherwise attach structures to such poles; and e. Such poles present shipping problems due to weight, length, and width.

Again, while concrete poles do provide some advantages, their disadvantages prevent them from being the preferred used type of pole.

These types of above-mentioned deficiencies have resulted in the pole of preference being comprised of a steel pole which is anchored in the ground usually to poured concrete fill. Such a combination allows the use of high strength yet lightweight hollow tube steel for the above ground portion, while utilizing lower cost and high weight concrete as the anchor in the ground. This also aids in installation as the concrete bases can be poured and then the lightweight steel poles mounted thereon.

These advantages do not come without a price however. The disadvantages of this type of pole are at least the following:

a. Most expensive;

b. Concrete and rebar (if used) must be custom designed;

c. Heavy, thick base plate must be welded to the lightweight steel tube;

d. Galvanizing, which is the preferred protective coating, is sensitive to the temperature differences between the thick base and thin tube;

e. Concrete foundations must be accurately constructed on the site according to the custom design;

f. The poles and the concrete fill, and any other hardware many times are required to come from different sources and therefore may not adequately match; and g. Corrosion problems.

As can be appreciated, the problems with steel and concrete foundation poles are not insignificant. Because the joint between the steel and concrete will have to take much of the stress provided by the long moment arm of the upwardly extending pole, and because of wind load and other factors, it is critical that for each installation the junction between the pole and the foundation be accurately and correctly prepared. This is an intricate matter requiring not only the correct design specifications and construction of the concrete foundation and the steel pole, but also accurate and faithful adherence to design and installation specifications by field personnel in forming the concrete foundation.

The custom design must include not only the height and weight requirements associated with each particular pole, but also must consider the type and strength of concrete used, the design of the rebar cage in the concrete, and the design and placement of hardware attaching the steel pole to the concrete.

As is well understood by those with ordinary skill in the art, a custom design for the concrete foundations requires significant expenditure of resources. Additionally, the success of the design is then entirely dependent upon its implementation in the field.

Unfortunately, a significant and real problem exists in contractors carrying out the installations not doing so accurately. Without a reliable match between the design parameters of the concrete foundation and the parameters associated with the steel pole with its actual installation, the entire pole structure is susceptible to damage or failure. Accordingly, substantial expense may be incurred over designing and installing the concrete foundations to allow for field installation tolerances. Additionally, concrete requires up to 28 days to develop full strength needed for tensile strength and to anchor the bolts used to secure the pole. The compressive qualities of concrete develop more quickly.

A second major problem with steel pole and concrete foundation combinations is that of corrosion. While presently the corrosion problems are addressed by attempting to galvanize all metal components, at least the following impediments exist to that being successful.

The best environment for corrosion is generally within a few feet above and below the ground line. Frequently, concrete and steel poles such as described above have the concrete bases or foundations poured and submerged from close to ground level downwardly. Therefore, the most corrosion-susceptible area of the metal, at or near the joint with the concrete, is in that area where corrosion is the most likely. Moisture in the form of standing water and condensation is most concentrated in this area. Additionally, this is also an area where the concentration of oxygen is high, which is one of the components of corrosion and rust.

Secondly, as previously mentioned, the joint between the steel pole and the concrete foundation often represents the highest stress area for the combination. It is known in the art that corrosion increases with stress.

Third, the conventional way of securing the joint is to utilize long bolts through a mounting plate of the steel pole into the concrete. These bolts also take a majority of the stress and are therefore very susceptible to corrosion.

Fourth, galvanizing simply cannot be very reliable for the following reasons. Stress is detrimental to galvanization. An annular base plate for the metal pole must be welded to the tubular elongated portion of the pole. For galvanization to be reliable, the surface must be extremely clean. Debris or dirt in general, and in particular flux, which is hard to remove around welded joints, will not take galvanization. Sometimes direct-bury steel poles are utilized. Corrosion problems as well as installation problems similar to described above exist.

Additionally, galvanization is accomplished by heating the metal. For reliable galvanization, the metal must be heated uniformly. However, the baseplate must be made of a much thicker metal than the thin tubular pole on a practical commercial scale. It is almost difficult during a reasonable production time to have a thick-in-cross-section metal portion connected to a thin-in-cross-section metal portion have the same temperature when exposed to heat.

Additionally, the chemical nature of the steel or metal must be known to obtain the correct galvanization result. Heat differences can even crack the weld or otherwise damage the joint or pole. The plate is generally made of a different metal than the pole.

In short, the mounting plate and metal pole must be galvanized inside and out to resist corrosion. For at least the above reasons, it is very difficult to get such a combination correctly galvanized. At a minimum, it is very expensive to do it right. Then, even once galvanized, the high stress in the area is damaging to the galvanization. Another risk is to cracking of the weld because of different thickness of metal.

It can therefore be seen that the conventional types of poles simply have significant and real problems which are detrimental or are disadvantageous. There is a real need in the art for a pole system which does not have these problems.

Additional problems with regard to presently used poles are also significant in the art. One very practical and real problem is involved with the shipping of such poles. For many uses, poles are needed of lengths of thirty, forty, and even up to over 100 feet. While some applications require many poles of similar lengths, and therefore may be sent by rail shipment, where long lengths can probably be accommodated, many applications for such poles require only a relatively small number. To ship such a number by rail is expensive, particularly when many of these applications still require some other type of over-the-highway transportation to the ultimate location.

Generally trucks have a maximum effective carrying length of between 40 and 48 feet, at least, for semi-trailers. However, the effective load carrying length generally is no longer than around 48 feet. Therefore, it is simply not possible to ship poles of much longer length than this via tractor trailer without special and expensive permits.

While attempts have been made to produce concrete poles in segments, this requires significant installation efforts and joints would create risk and problems. Additionally, it must be understood that wood and concrete poles, with their heavy weight, present shipping problems. Even with shipment in tractor trailers, there is a weight limit of approximately 45 thousand pounds, even for the longest semi-trailers. This would limit the number of such poles that could be transported in one truck as some poles, such as concrete, can each weigh several thousand pounds, and even around or over ten-thousand pounds. Additionally, weight permits are required for increasingly heavy loads. Thus, the closer you come to the maximum weight per trailer and truck, the more costs are incurred in obtaining permits and the like for such heavy loads. This is important because optimally the goal would be to have one tractor trailer carry all the poles and parts required for one installation. Because of limit on truck length and load weight limits, concrete and even wood poles have certain limitations.

Still further, for steel poles which are installed with conventional poured concrete foundations, it may be possible to transport the poles in trucks, but a disadvantage is again the requirement that the concrete foundations be created and installed by a local contractor where, in most cases, quality control is less reliable. In other words, the entire combination (pole and foundation) cannot be manufactured and shipped as one unitary shipment and much reliance on a successful installation is with the installer at the site.

It is to be understood that another problem with conventional poles is the difficulty in flexibly and economically creating a base for the pole which will support the pole and prevent tilting of the pole by the number of forces which will be experienced and caused by the pole. For example, a wood pole has its relatively small diameter lower end inserted into the ground. Many times this is insufficient to adequately support the pole because the ground will give way to the variety of forces transmitted down the pole to its base. To prevent this, sometimes a hole larger than the diameter of the wood pole is bored in the ground and then the space between the pole and the walls of the hole are filled with concrete or crushed rock or other backfill. This effectively provides material surrounding the pole which is not easily displaced. It is one way to attempt to effectively increase the diameter of the base of the pole in the ground. To add backfill and to tamp it, or otherwise secure it, requires time, machinery, and effort. It also requires a crane to hold the pole vertically while this is being accomplished, which is also time consuming and expensive.

Steel poles which are attached by bolts to concrete bases in the ground is a way to allow the base to be customized for the type of ground or the forces that the pole will exhibit on the base. However, it is expensive and time consuming to customize a rebar cage and pour the concrete so that it exhibits not only compressive strength but tensile strength. This is needed to provide enough strength at the junction of the pole to the concrete by bolts or other fastening means.

If concrete poles are used, similar problems exist with regard to wood poles. There is therefore a real need in the art for a method to provide a base or foundation for a pole whose effective area can be economically designed, to adopt whatever supporting strength is needed for each situation. Sometimes the base area needs to be large, sometimes it does not need to be so large. There is also a need to keep the base aligned or leveled so that when the pole is attached, the pole will also be in a desired position. It is important to have enough square feet of surface for the base, but also to do it economically.

There is also a problem in the art as to how to optimally utilize the light from a plurality of light fixtures elevated on a pole. Under conventional systems, there is no integrated approach to figuring out what types and how many lighting fixtures are needed for each light pole or combination of light poles, to accomplish a certain lighting criteria. One of the reasons this is not possible is that conventional light pole systems are not very adjustable once the pole is erected. For example, once a wood pole is elevated and concrete or backfill is secured around the base, it cannot be adjusted either vertically, horizontally, or rotationally. A steel pole which is bolted to a concrete base has similar problems. Therefore, much of the adjustment would have to take place by going up to the light fixtures on top of the pole and trying to adjust them.

In essence, there is no way to reliably predict prior to assembly, the exact orientation of the light fixtures, cross arms or supports, and pole, with respect to one another, and with respect to the area which is to be lighted. There is therefore a real need to allow reliability and certainty in these arrangements prior to actual erection of all these components.

Still further, there is a need for the ability to allow the base or foundation of the pole to accurately and reliably predict the position of the top of the pole and light fixtures attached to supporting structure at the top of the pole before it is erected. With such reliable knowledge, the composite lighting system of a plurality of fixtures each on a plurality of poles can be predesigned at the factory, shipped in partially assembled form, and then easily and economically assembled on site. This would allow the significant advantage of avoiding duplication of lighting and most efficiently and economically providing lighting to an area on top of an efficient and economical way of installing the actual poles and bases, and lighting fixtures.

The above rather detailed discussion of conventional poles is set forth to attempt to aid in an understanding of the many factors which are involved in choosing a type of pole, manufacturing it, installing it, and ultimately maintaining it for an extended, economical, and effective useful life. There is no presently satisfactory system which is adaptable to virtually every situation, is flexible in that it can be anchored in all sorts of locations and ground types and all sorts of weather environments, and is useful for all sorts of heights, wind loads, and types of structures to be elevated. For example, steel poles which are secured to concrete bases generally require the base to be fabricated on-site. Rebar cages and concrete must be designed to meet needs of compressive and tensile strength. This takes time and materials. There is a need for a less complicated, quicker system that does not need such reliance on tensile strength of the concrete.

Still further, for purposes of economy, there is a real need for a pole system which can be easily shipped, whether only a few or quite a few; is easy in terms of labor and resources to install; and which can be maintained over a long life span.

Finally, there is a real need for an efficient pole system which allows easy installation and shipment of the entire system together, along with the structure or structures to be elevated and any attendant hardware, such as wiring and the like.

It is therefore a principle object of the present invention to provide a means and method for rigidly elevating a structure which improves over or solves the deficiencies and problems in the art.

Another object of the present invention is to provide a means and method as above described which is generally universal in its application for elevating different structures to different heights for different situations, and with respect to different installations of the base in the ground.

A still further object of the present invention is to provide a means and method as above described which is economical in terms of the manufacture, materials, transportation, installation, labor, and life span.

Another object of the present invention is to provide a means and method as above described which is easy to assemble, install, and maintain.

A still further object of the present invention is to provide a means and method as above described which is durable and strong, both in its individual components and compositely.

Another object of the present invention is to provide a means and method as above described which permits preinstallation design and concurrent shipment of all or most components for each installation.

A further object of the present invention is to provide a means and method as above described which improves corrosion resistance.

Another object of the present invention is to provide a means and method as above described which is an improvement with respect to the problems caused by stress.

Another object of the present invention is to provide a means and method as above described which allows for economical and efficient provision of a supporting base in the ground for a pole, where the base can be easily predesigned and installed for a variety of ground types and pole strength and heights.

A still further object of the present invention is to provide a means and method as above described which facilitates the provision of a composite photometric output from a plurality of light fixtures for each pole, by allowing the fixtures to be quickly and easily aligned to a predetermined position and orientation, and allowing the fixtures to be reliably erected to a position of known and reliable relationship to the target area for the lighting.

As is well known in the art, the conventional way to install elevated lighting fixtures is to transport a pole to the site it will be erected in the ground. Secondly, before erection, some sort of supporting structure such as cross arms are secured to a position near the top of the pole by brackets or otherwise. Third, the lighting fixtures are mounted onto the cross bars by brackets or other means. Fourth, wiring is installed from the light fixtures to electrical components such as ballasts, fuses, and the like. The ballasts and other components also have to be attached to the fixtures, cross-bars or pole by brackets or other means. The complete assembly is then erected by a crane and held in position until the portion of the pole in the ground is adequately supported.

The installation process therefore requires a plurality of steps. Some of the steps require different types of expertise. One party might supply and ship the pole. Workers for another contractor may install cross arms and fixtures. Electricians are usually needed for wiring the fixtures to the required components and connection to electrical power.

As can be appreciated, expensive bracket structures are many times needed to construct the cross bars to the top of the pole and to attach light fixtures and wiring at the top of the pole. Sometimes attachment of ballasts (generally at the top of the pole), requires special equipment and efforts.

Additionally, the amount of time needed for the construction of the complete unit is substantial. Each stage of the installation process many times requires various personnel, different completion times, and many times different equipment and supplies. Still further, once the basic components are installed on the pole, the pole must be raised and inserted into the ground or on a base. It must then be held there by a crane until secure, which further prolongs the time and expense of the installation. Once secured, it can not be reoriented or adjusted.

There have been various attempts to address certain of these problems. However, none has comprehensively addressed these concerns and developed an integrated way to produce savings in time, money, and effort.

The inventors Gordin and Drost disclose a pole structure which addresses a portion of the installation of this type of lighting. The base can be accurately secured in the ground with significant savings of time and cost. The pole can be quickly and relatively easily erected on the base with a reduced risk of corrosion problems. If desired, the cross bars can be attached to the pole before erection onto the base. That invention addresses certain problems in the art, such as quicker and easier pole construction. It removes the necessity of installing cross bars and lights once the pole is erected, or at least allows adjustment of the pole once directed onto the base, instead of having to hold the pole while the concrete is setting up or rearranging the cross arms or lights once installed on the cross arms.

The present invention comprehensively addresses all problems involved in lighting installation in the following way. A breakdown of the various concerns for ultimate installation of this type of lighting can be visualized in the following matrix:

| | A Lights | B Pole | C Elec. |
|---|---|---|---|
| 1. Design | 1A | 1B | 1C |
| 2. Manufacturing | 2A | 2B | 2C |
| 3. Supply | 3A | 3B | 3C |
| 4. Installation | 4A | 4B | 4C |

-continued

| | A Lights | B Pole | C Elec. |
|---|---|---|---|
| 5. Operation | 5A | 5B | 5C |
| 6. Maintenance | 6A | 6B | 6C |

Numbers 1–6 list various stages involved with a lighting system from origination to ongoing operation. Letters A–C list the primary structural components of a complete lighting installation.

The boxes 1A–6C of the above matrix are intended to exemplify the many different areas of concern when dealing with lighting applications of the type addressed by the present invention. No single, integrated, approach to all these areas exists in the art. As previously stated, this is extremely significant from the standpoint of the costs in time and money involved with present day methods. Some examples are given below.

With regard to matrix position lA, resources directed to design of lights tend to be limited to the efficiencies and economies in manufacturing, operation and maintenance of the lights, along with design of how they will functionally operate for certain applications. There is a lack of concern with regard to how the lights will be shipped (matrix box 3A) or how they will be installed (matrix box 4A).

While some design efforts of lights might also be directed towards the electronics associated with the lights (matrix box 1C), there is a noticeable absence of prediction and coordination with the characteristics of poles (matrix boxes 1B–6B) and the total electrical setup with each light and pole (matrix boxes 2C–6C).

By further example, designs of poles are centered on how to make the pole either easy to manufacture (box 2B), or cheap to manufacture and install (boxes 2B, 4B). Minimal concerns are given towards integration with lights or electrical components (boxes 1A–6A, 1C–6C). A major concern is getting the pole in the ground and securing it there. Thereafter, it can require considerable effort to adjust the lights to a desired orientation, since the pole is nonadjustable.

The primary point of showing the eighteen different matrix positions is to emphasize the complexity of coordinating and integrating all of these factors into an economical yet valuable coordinated lighting installation.

Not only is there an absence of coordinated integration of these factors in the art, additionally there is room for improvement in individual components or methods in the matrix, or sub-components thereof. For example, the design of one light pole may be economical, but it may be less durable than other types, or even less aesthetically pleasing. The structure for fixing the lights to the top of the pole might be easy to manufacture, but extremely difficult and unreliable as far as securement to the pole, accuracy in supporting the lights, or even in the efficiency and economy of the amount of material used.

By still further example, prior art methods of aiming lights once installed in the top of the pole require significant labor. Little consideration is given to the design and manufacturing of the pole structure to reduce the amount of time needed for mounting and aiming the fixtures.

By still further example, because of the separate steps involved in installing a lighting installation, preparation of the electrical components and wiring is usually left until last. It requires electricians and labor to customize the length of the wires, and to install ballast boxes and other components by brackets or other methods to erect a pole and light fixtures. There is an absence of consideration of design and manufacturing to be able to prewire and prepackage all the components necessary for a certain light pole and fixtures at the factory. Still further, there is a noticeable lack in the prior art of being able to design and contemplate the supply or shipping of component parts for several poles, lighting fixtures, and electrical components, to a site by economical and available transportation systems. There is also a lack of contemplation of positioning the components (such as ballast boxes) at a convenient location for future maintenance.

It can therefore be seen that a real need exists in the art for an integrated approach to lighting installations, and that particular components or methods in the prior art also could be improved.

These areas of need for improvement start with the design of lights, pole, and electrical components, and extend all the way to maintenance of the same. An integrated approach looking at all factors of the matrix discussed above is both needed and would be extremely advantageous from an economic point of view, as well as with regard to flexibility and uniformity of lighting installations.

The need of an integrated approach to design (row one of the matrix) would be to design the best lighting fixtures, poles, and electrical components for the application, allow flexibility so that they could be used in different ways and combinations, and provide esthetically pleasing structures; all to provide good function and result for the application. Manufacturing (in row two of the matrix) looks to efficiency and use of materials and expensive labor, along with high reliability, flexibility, and functionality.

Supply (in row three of the matrix) refers to the ability to package and ship all of the components from the factory with high flexibility to minimize the number of different parts that need to be manufactured and the ability to satisfy a variety of different applications.

Installation (in row four of the matrix) demands improved speed with minimization of labor and expensive equipment, but with reliability and accuracy.

Operation (in row five of the matrix) demands simplicity, durability, and reliability, as well as functional advantages.

Finally, maintenance (in row six of the matrix) looks to ease and simplicity of servicing, repair, and replacement of parts.

Some of the prior art addresses individual particulars of the matrix, but none looks at the total integrated picture, or even substantial sections of the matrix.

It is therefore a primary object of the present invention to provide a means and method for integrated lighting fixture supports and components which solves or improves upon the problems and deficiencies in the art.

A further object of the present invention is to provide a means and method as above described which uses an integrated comprehensive approach to all the stages of lighting including design, manufacturing, supply, installation, operation, and maintenance of lighting fixtures, poles, and electrical components to operate the lights.

Another object of the present invention is to provide a means and method as above described which reduces the amount and cost of labor involved in all stages.

Another object of the present invention is to provide a means and method as above described which reduces the cost of all stages.

Another object of the present invention is to provide a means and method as above described which reduces the time involved in all stages.

A still further object of the present invention is to provide a means and method as above described which reduces the possibility of errors in all stages.

Another object of the present invention is to provide a means and method as above described which allows more accurate, reliable, and durable installation.

Another object of the present invention is to provide a means and method as above described which is more efficient and economical in all stages.

A still further object of the present invention is to provide a means and method as above described which is very flexible and adaptable to a variety of different applications.

Another object of the present invention is to provide a means and method as above described which can be utilized on new lighting installations, or in replacement installations.

A still further object of the present invention is to provide a means and method as above described which can be utilized for a variety of different heights of poles, number of lights, and electrical component and power situations.

Another object of the present invention is to provide a means and method as above described which can be substantially predesigned, packaged, and shipped at the factory.

Another object of the present invention is to provide a means and method as above described which can be preassembled to some extent at the factory in a variety of different configurations yet still meet dimension and weight requirements for standardized shipping of components to installation site.

Another object of the present invention is to provide a means and method as above described which allows the use of an insertable pole top unit on top of a tapered light pole, when the vertical member of the pole top which connects to the tapered pole is modified to have a tapered lower end, where the taper is created from a straight type by flaring the bottom end, as opposed to manufacturing a tapered section.

These and other objects, features, and advantages of the present invention will become more apparent with reference to the accompanying specification and claims.

SUMMARY OF THE INVENTION

The present invention relates to means and methods for an improved pole system for rigidly elevating an object or structure in the air with a base anchored in the ground. The invention specifically solves or improves over many of the deficiencies in the prior art by utilizing a special concrete base which is anchored in the ground but to which a lightweight, strong steel pole section or sections can be easily yet reliably secured.

The base includes an upper portion which extends above the ground. The pole has a mating interior bore at its lower end which slip fits over the upper section of the base, but does not get nearer than a few feet from the ground. The upper portion of the base and the interior bore of the pole can either both be tapered in a manner that the pole can be slip fitted a predetermined distance onto the tapered part of the base and secured there, or if the parts are not tapered, have a stop member control how far the pole fits over the base.

Optionally, the pole can be comprised of a plurality of steel sections, each added to the top of the preceding section in turn beginning with the steel section attached to the base in a similar manner by slip fitting each section to the other.

The invention also allows for a base or foundation which can be enlarged economically and efficiently, as needed, to accommodate different types of ground or soil conditions and for different sizes, strengths, and heights of poles. A pretested, prestressed concrete base is positioned and plumbed within a bore in the ground. The bore in the ground is sized according to how much support will be needed. The system relies only on the compressive strength of the concrete, as well as its rigidity when set up to effectively enlarge the size of the base in the ground.

Additionally, the invention allows for a reliable accurate, pre-known positioning of the light fixtures on top of the pole, even though they can be suspended sometimes over 100 feet in the air. The base can be plumbed and set. The pole and pole top, having known, predesigned and reliably consistent relationships, will also end up in pre-defined, pre-known position once the pole is erected on the base. This allows for integration with a three dimensional coordinate system centered on the target area to be lighted. It also allows for a factory pre-design of the number of fixtures, their aiming and orientation, to economize on the number of fixtures needed, and to create a composite efficient beam from each pole that in turn can be integrated with a number of poles for the best possible and most economical lighting.

The invention also allows for the pole top member to be made economically, even though it requires, in some embodiments, a flared lower end to be mated with the flared upper end of the light pole. A straight pipe can be used for the vertical member for the pole top and have its bottom end flared for mating slip fitting on top of the tapered pole. This reduces significantly the cost of the pole top member as opposed to utilizing a tapered center section.

The system therefore provides a strong, almost unitary pole structure which can be adapted to virtually any situation or location. The strength of the base can be designed to accommodate various pole heights and various ground conditions by altering the makeup of the concrete of the base and any reinforcing structure, as to the width of the base, and the length of the base and other factors. The pre-manufactured base can literally be expanded to meet specific strength and support needs by the single step of widening the hole in the ground and pouring concrete around the base as it is held plumb. This effectively expands the area of the base. Also, predefined simple methods of field modifications can be made. In all instances, any metal portions of the pole are kept out of the high corrosion zone near the ground level. Yet, the above ground portion of the system is almost fully comprised of the light weight, yet strong steel. In turn, the base is made of the relatively heavy, stable concrete which cannot corrode.

The invention also relates to the ability of the system to be easily adapted, assembled, and installed. The invention advantageously overcomes the problems associated with installation such as reducing labor costs, material costs, and design costs. It also provides ways to insure installation is reliable such as providing for ways to plumb the base and/or pole segments to insure that the base, and consequently the pole, are plumb after installation.

Still further, the invention overcomes the severe problem in the art of not being able to easily custom design the system of pole structures for each installation and then easily ship, install and maintain those poles.

Additional features and advantages of the invention includes a means and method for an integrated approach to a total lighting installation. Normally, the design, manufacture, and installation of lighting fixtures for lighting installations is quite independent and separate from those same stages with respect to how the lights are elevated and supported, and how the lights are electrically connected to electrical components and an electrical power source. The present invention allows a comprehensive and integrated approach to the design, manufacture, shipment, installation, operation, and maintenance of lighting fixtures, supports and poles, and electrical wiring and components.

A number of different structural features of the invention can be utilized to further this integrated and comprehensive approach. The tapered, slip-fit pole and base described previously can be utilized. A unitary slip-fitable top portion of the pole, with pre-defined relationships between cross arms and the vertical axis of the pole can also be utilized. The manufacturing process can allow the structure to be easily adapted to prewiring and preassembly of light fixtures to the pole top at the factory.

Mounting brackets for ballast boxes to the poles can facilitate quick and easy mounting of the boxes to the pole. Additionally, the ballast boxes themselves are configured at the factory to be almost completely preassembled and prewired. The ballast boxes are actually electrical component enclosures to allow the pre-assembly, prewiring and integration of a number of electrical components beyond just ballasts. With respect to this invention, the term "ballast box" will be used interchangeably with "electrical component enclosure". Substantial savings in time and installation costs are achieved by minimizing the amount of work that needs to take place to install and erect the entire lighting installation on site.

The components are manufactured in a manner that they can be easily shipped by convenient, efficient, and economical transportation vehicles. Still further, the components of the entire installation are designed to be able to be selected to meet a variety of desired configurations for different applications. Different pole heights and strengths, different numbers of fixtures, and different wiring and electrical requirements can be easily met without much on-site customization.

Still further, means can be used to increase the durability and reliability of the lighting installation. For example, abrasion and trauma resistant members can be utilized with the wiring extending through the pole to minimize damage or breakage. Strain relief devices can also be utilized to eliminate the risk of damage to the wiring. Specific structure for attachment and communication between components such as ballast boxes and poles is utilized to increase reliability of operation and reduce the risk of water damage or deterioration of the components over time.

The concrete base can be prefabricated. All it requires is some backfill of suitable strength to hold the base against the forces it will experience. Components, such as ballast boxes, can be located at convenient locations for access, once the installation is complete. The pole, generally steel, is upon ground, but near enough the ground to utilize its advantageous properties.

Whether utilized collectively or individually, these enhancements and features represent real savings in time and cost with respect to the installation of lighting structures.

BRIEF DESCRIPTION OF THE DRAWINGS

FIG. 35 is a front view of a segment of a pole illustrating the attachment of a ballast box to the pole.

FIG. 36 is an enlarged view taken along line 36—36 of FIG. 35.

FIG. 37 is similar to FIG. 35 but showing an additional step in the installation of a ballast box according to the present invention.

FIG. 38 is an enlarged isolated view taken along line 38—38 of FIG. 37.

FIG. 39 is similar to FIGS. 35 and 37 except showing the completion of installation of a ballast box according to the present invention.

FIG. 40 is an enlarged isolated view taken along line 40—40 of FIG. 39.

DETAILED DESCRIPTION OF THE PREFERRED EMBODIMENT

Figure 1:
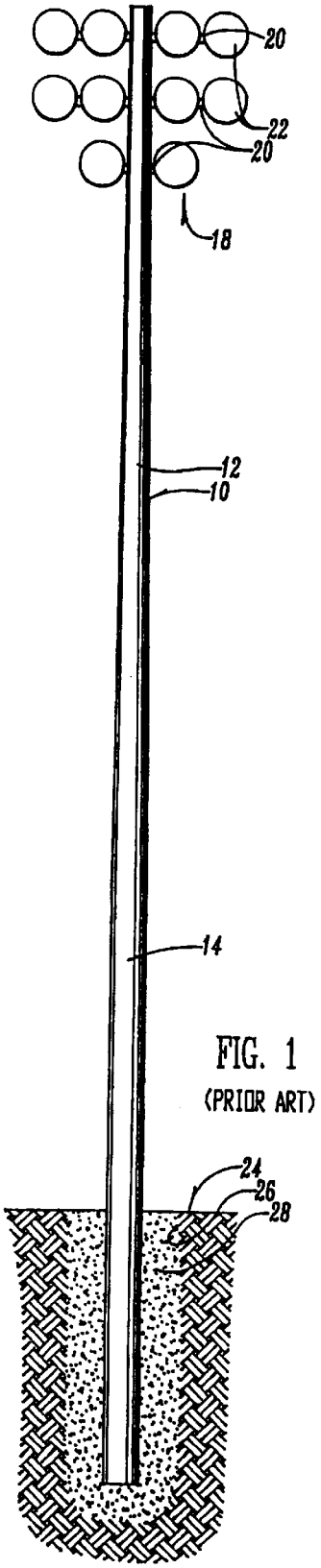
FIG. 1 (PRIOR ART)
FIG. 1 is a front partial sectional view of a prior art wooden pole set into the ground.

The detailed description of the preferred embodiments of the present invention will now be set forth. It is to be understood that this detailed description is intended to aid in an understanding of the invention by discussing specific forms the invention can take. It does not, nor is it intended to, specifically limit the invention in its broad form.

This detailed description will be made with specific reference to the drawings comprised of FIGS. 1 through 25. Reference numerals are used to indicate specific parts or locations in the drawings. The same reference numerals will be used for the same parts or locations throughout the drawings unless otherwise indicated.

The broad invention has generally been described in the Summary of the Invention. It is to be understood that in the following description of specific preferred embodiments, the structure elevated by the poles will be light fixtures or arrays of light fixtures, such as are commonly used for lighting sporting fields such as softball fields, tennis courts, and the like. An example of one type of such arrays and fixtures can be found at commonly owned U.S. Pat. No. 4,190,881 by Drost and Gordin issued Feb. 26, 1980. As will be further understood, the present invention and all its preferred embodiments achieves at least all of the stated objectives of the invention. It provides a pole system which can be predesigned for specific applications. As will be understood further, the preferred embodiments of the invention will show how the system of the invention can be predesigned for a particular application and location. Furthermore, the invention is basically universal in that it can accommodate almost all combinations of height, weight, location, ground condition, shipping requirements, and installation problems. It can also maintain the critically important alignment both vertically and rotationally.

The invention accomplishes all of its objectives economically and by providing a strong, reliable, long lasting pole and base.

To emphasize the advantages of the invention, the description will first again briefly review some of the problems and deficiencies of commonly utilized prior art poles. The advantages of the present invention will then be briefly discussed with particular reference to use as light poles, and then the specifics of the invention as applied to light poles will be set forth.

FIG. 1 shows a wooden light pole 10 having an upper section 12 and a lower section 14. An array of light fixtures 18 includes three cross arms 20, each carrying a plurality of light units 22 and is attached to upper section 12 of pole 10 by means known in the art (not shown).

Pole 10 is installed in ground or soil 24 in an excavation hole 26. As is commonly done in the art, the space around pole 10 in hole 26 is filled with a filler material to attempt to better anchor pole 10 in the soil 24. Examples of material 28 are soil, tamped rock, or poured concrete, such as is known in the art. Concrete has the advantage that it does not depend as heavily upon the skill of the contractor for a reliable foundation. Tamping rock properly in a deep hole is difficult and time-consuming.

The problems with wood poles have been previously discussed. Briefly, they are fairly heavy, are susceptible to rot and decay, and it is difficult to find tall and straight poles. Twisting and warping can also cause problems, such as misalignment of the structure held by the pole, for example, light fixtures. Perhaps more significantly, the installation of the lower section 14 into ground 24 requires an exact and well executed process to make sure the pole is vertical or plumb, and that it will stay that way. Transportation of long poles is also a problem.

As can be well appreciated by those of ordinary skill in the art, sometimes poles are simply inserted into hole 26, which is then backfilled with the removed soil. Soil simply does not have the density or properties to reliably hold the pole in aligned position either from axial, twisting (rotational), or lateral movement over time. By adding material 28, the effective area of the portion of pole 10 in ground 24 is increased, and the properties of the material are such as to improve stability.

This process still relies significantly on the type of installation job done by the installers. It can be seen that the wood is exposed at ground level to moisture as is previously described.

It is also to be understood that if crushed rock is used as material 28 when installing any type of pole, it is crucial that it be tamped accurately or the pole will lean. This requires the rental or use of pneumatic tamper machine and knowledge of how to accurately perform the tamping. This is a time-consuming task.

Figure 2:
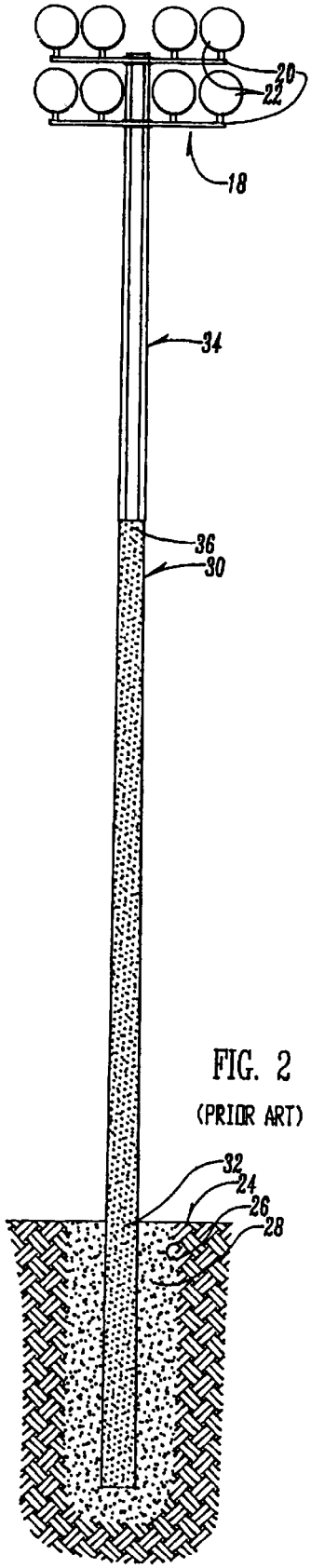
FIG. 2 (PRIOR ART)
FIG. 2 is a similar front elevational view of a prior art substantially concrete pole set into the ground.

FIG. 2 similarly shows concrete light pole 30 having a lower end 32 anchored in ground 24 surrounded by material 28 like the embodiment of FIG. 1. Additionally, in this prior art embodiment, a steel top section 34 is fitted over top end 36 of pole 30 and array 18 of lights is in turn connected to top section 34.

The problems with concrete poles have been previously discussed. Although corrosion around ground level is not a problem because of the use of concrete, the extreme weight of such a mass many times causes pole 30 to sink into the soil or otherwise tilt or laterally move. Similar problems in installation for concrete poles exist as with pole 10 of FIG. 1. Transportation of long poles because of length and weight is also a problem.

Figure 3:
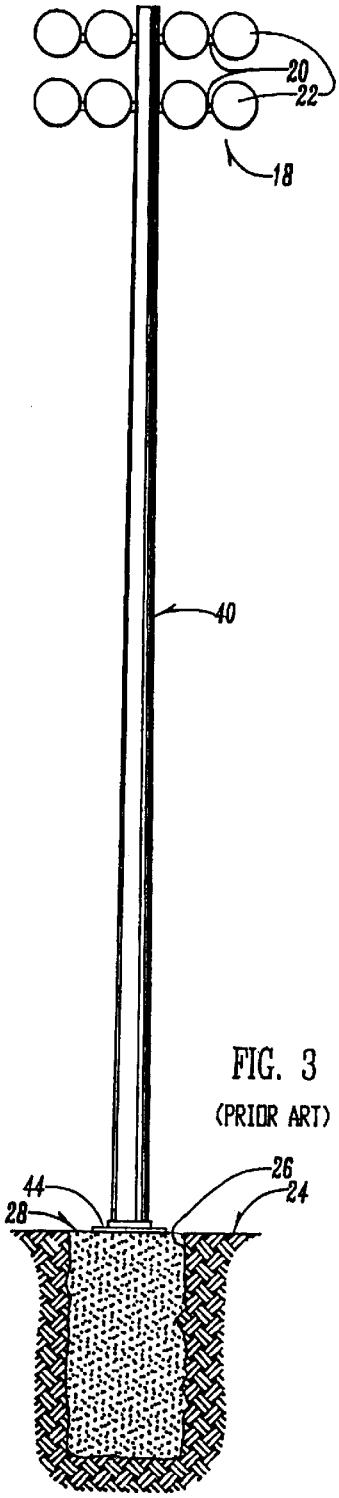
FIG. 3 (PRIOR ART)
FIG. 3 is a similar front elevational view of a steel pole with a poured concrete foundation in the ground as known in the prior art.

Therefore, FIG. 3 depicts the prior art light pole of preference, namely steel light pole 40 which is connected to bolts 46 (see FIG. 5), which are secured in material 28, which is generally concrete. Array 18 of lights is secured by means known within the art to the top of steel light pole 40, whereas the bottom of pole 40 has an annular flange 44 surrounding tubular pole 40 which is welded to pole 40 and secured by bolts to material 28. Material 28 is poured concrete with a rebar design that must be installed on-site and is used to fill excavated hole 26. It can be seen, however, that flange 44 is within the high corrosion area near the ground.

Additionally, such as is known in the art, the joint created at flange 44 bears a high amount of stress for the entire combination. It therefore presents an unreliability factor in the sense of concentrating a significant amount of stress in one location. This is particularly true when referring to the potential corrosion problems created by the joint. It must be additionally understood that many times moisture accumulates within the interior of these hollow poles and corroded material and moisture can fall through the pole to the area around flange 44. This adds to the possible corrosion. Corrosion is virtually as big a problem inside-out as it is from the outside-in for these types of poles.

Even though the pole of FIG. 3 is the most expensive, for reasons previously described, it is also the most preferred because it is lightweight, strong, aesthetically pleasing, and its installation is relatively easy when compared to a preferred ground concrete fill (FIG. 3) or properly tamped rock backfill, and when compared to installations such as is shown in FIGS. 1 and 2 which require a large crane to handle the higher weight of the wood or particularly the concrete poles. Additionally, if material 28 is cement, for optimum results, the crane must continue to hold the poles until the concrete is basically set. This requires time and money to rent the crane for that period, and hire the labor for that period, as opposed to pole 40 of FIG. 3 where the concrete fill 28 can be set (requires up to 28 days to set up) and then the pole 40 afterwards installed. It is to be understood that the setup time for concrete is generally in terms of hours. Concrete truck cannot wait hours at a time. Therefore, it requires generally a truck trip per pole which can be very expensive. Also, unless multiple cranes are available, only one pole can be installed over a period of hours.

Figure 4:
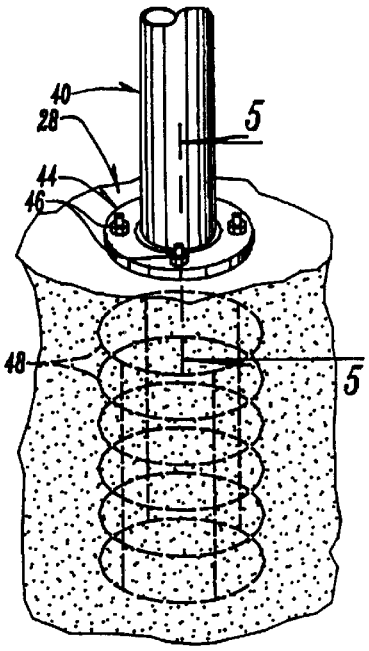
FIG. 4 (PRIOR ART)
FIG. 4 is a perspective view of the foundation and lower portion of the steel and concrete pole combination of prior art FIG. 3.
Figure 5:
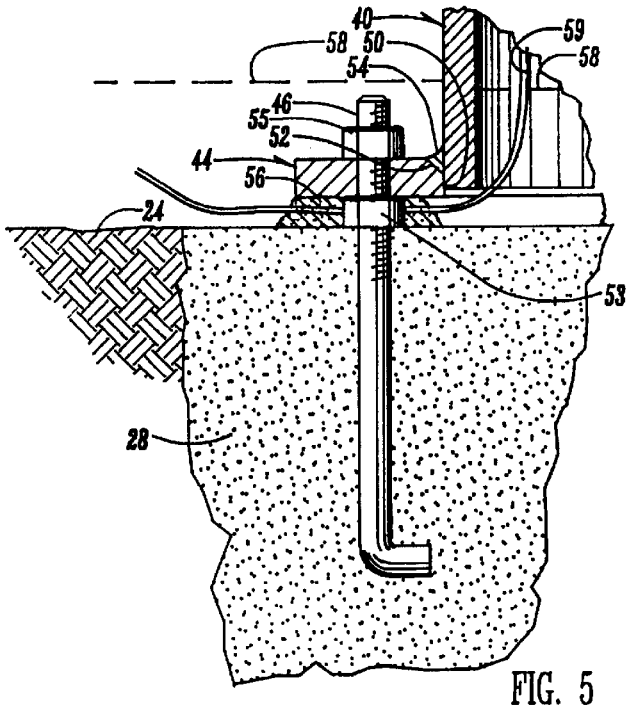
FIG. 5 (PRIOR ART)
FIG. 5 is a sectional view taken along line 5—5 of FIG. 4.

FIGS. 4 and 5 show in more detail the specifics of pole 40 and poured foundation 28 and 42 of FIG. 3. In FIG. 4, it can be seen that flange 44 is attached to fill material 28 by the use of long bolts 46 which extend deep into the material 28 and are set there when the concrete is formed. Additionally, lines 48 represent generally the rebar or reinforcing bars that need to be designed into material 28 for each specific application. Because bolts 46 extend deep into material 28, a significant amount of stress of the whole system must be borne by material 28 so that bolts 46 will not pull out. Thus, the special and specific designing of each foundation 28 for each application (pole height, weight, wind load, etc.) must be accurately predicted and implemented into the foundation 28 for it to be successful.

FIG. 5 depicts bolts 46 and also shows how flange 44 receives a portion of the bottom of the pole 40 in circular aperture 50 that is completely through flange 44. Many times an angled or beveled edge 52 is machined into flange 44 at the upper junction between material 28 and pole 40 to allow for weld 54. FIG. 5 shows how thicknesses of flange 44 and pole 40 vary, how it would be crucial for weld 54 to be done accurately, and how the various problems with corrosion and galvanization can occur as previously described. It is to be understood that many times, to get a strong enough junction weld 54 must be a "triple weld" which refers to multiple layers of welds around pole 40 in the groove formed by beveled edge 52. The expense for this is substantial as well as the reliance on the effectiveness of the welds. It complicates the galvanization because of significant heat and residue flux. It is to be understood that welds could also be placed inside aperture 50 at the bottom of pole 40.

FIG. 5 also shows that conventionally, nuts 53 are first threaded onto bolts 46. Base plate 44 is then inserted onto the bolts and rests on nuts 53. Nuts 55 then secured plate 44 to bolts 46. Grout 56 is used to attempt to seal between plate 44 and foundation 28. The stress on the joint can therefore be seen. Also, sometimes conduit or wiring 59 must be run through grout 56 into pole 40. As can be appreciated, water (represented by line 58) can accumulate or stand exactly around this joint, both outside and inside the pole, whether from rain, condensation, or other causes. The grout, manner junctions between parts, and openings presents a risky corrosion environment right at or near ground level.

Therefore, the preferred embodiments of the present invention illustrate how many of these problems in the prior art are overcome. The following will be a brief description of the elements for preferred embodiments of the present invention. Discussion of how the system of the invention allows for easy design, manufacturing, installation, and maintenance will follow that.

Figure 6:
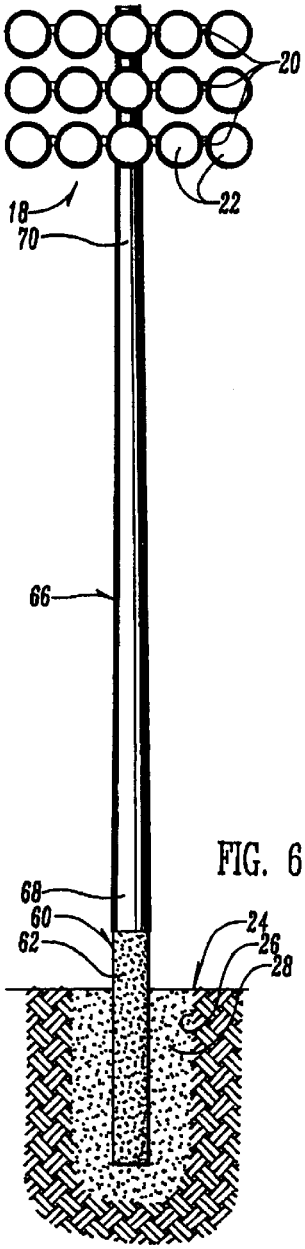
FIG. 6 is a front elevational view with a partial sectional view around the base of one embodiment of the invention.

FIG. 6 shows one preferred embodiment of the invention. A pre-cast, prestressed concrete base 60 has a lower section 62 which can be anchored in ground 24. It is generally preferred to anchor base 60 in material 28 which is poured concrete. An upper section 64 (see FIG. 8) of base 60 is tapered inwardly and upwardly. It is to be understood that the tapered upper section 64 is above ground level of ground 24 and preferably generally two or so feet above ground 24. It should also be understood that upper section 64 does not need to be tapered as will be later discussed.

The invention allows a pole to be comprised of either one steel section, or several relatively short, lightweight, and convenient-to-assemble sections. With respect to a pole holding an array of lights for an athletic field, this allows:

1. Ease of separately establishing a pre-manufactured concrete base rigidly fixed in the earth;
2. Advantage of a lightweight but strong top section preassembled with a pre-aimed array of fixtures which must accurately point to the field; and
3. Easy attachment of the pole to the base with universal orientation of lights to the field.

In the embodiment of FIG. 6, a pole section 66 is slip fitted onto tapered upper section 64 (see FIG. 8) of base 60. Pole section 66 itself is tapered along its entire length from its lower end 68 to its upper end 70 to which is attached light array 18. It is to be understood that the inside diameter of lower end 68 of pole section 66 equal to or is just slightly larger than upper section 64 of base 60 when it is slip fitted down onto upper section 64. However, because of the relative tapers, the farther pole section 66 is brought down upon upper section 64 of base 60, the tighter the two components become locked. Therefore, by utilizing sufficient force, the base 60 and pole section 66 can virtually become locked together without additional hardware.

This means that the outside diameter of lower section 62 of base 60 is greater than the inside diameter of part of pole section 66. It is again to be understood that the invention also contemplates use with bases and pole sections which are not tapered.

In FIG. 6, pole section 66 could be about 40 feet in length with a bottom inside diameter of around 9½ inches, and can utilize a 0.07 inch per foot taper uniform around the pole's circumference (as measured along a side of the pole section (66). Base 60 has a similar 0.07 inch per foot tapered top section 64 approximately 6 feet long with an overall length of close to 15 feet. The outside diameter of lower section 62 of base 60 is also around 9½ inches.

Figure 7:
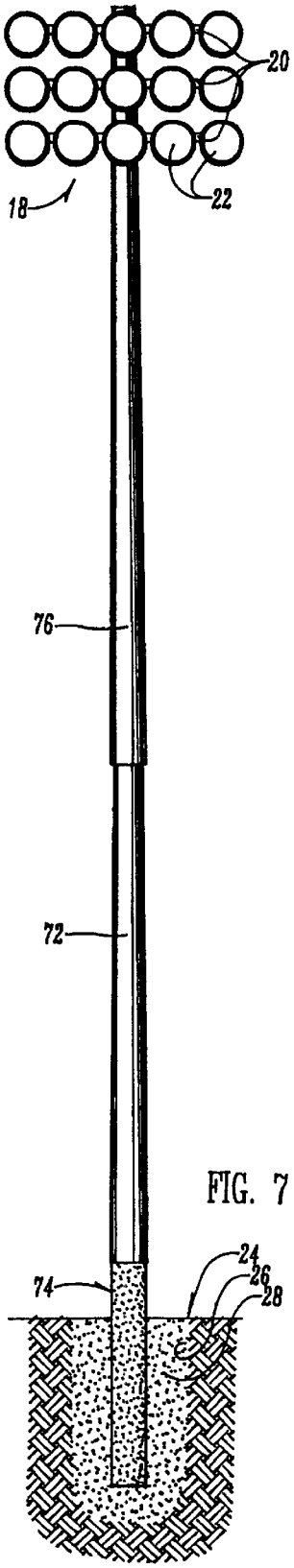
FIG. 7 is a similar view to FIG. 6 showing an alternative embodiment of the present invention.

FIG. 7 shows an alternative embodiment for the invention. Instead of just one pole section 66, a lower pole section 72 is slip fitted onto base 74 and an upper pole section 76 having the same taper from top to bottom as section 72 is slip fitted onto the top of lower pole section 72. It can be locked into position in the same manner as previously described. It can therefore be seen that a plurality of pole sections can be added to base 60 to achieve required height for a structure. It is to be understood that the width and length of base 60 or 74 is designed for overall height, weight, and load carrying ability for each pole structure. Generally, the width and height of base 74 would be greater than that for base 60 under fairly similar conditions because of the added height.

In FIG. 7, base 74 is around 20 feet long with a lower section diameter of around 13½ inches. Pole section 72 is 40 feet long, has a lower diameter of around 13½ inches and is slip fitted about 6 feet down on base 74 but not lower than about 2 feet above the ground. Twelve feet of base 74 extends below ground therefore. Pole section 76 is around 30 feet long, has a lower end diameter configured to allow it to slip fit approximately 2 feet over the top of pole section 74. Appropriate gauge steel is selected for height and load, and the strength of base 74 is computed for these parameters. Generally, most poles must be made to withstand 80 mph wind with 1.3 gust factor which includes consideration of fixtures attached at the top.

Figure 8:
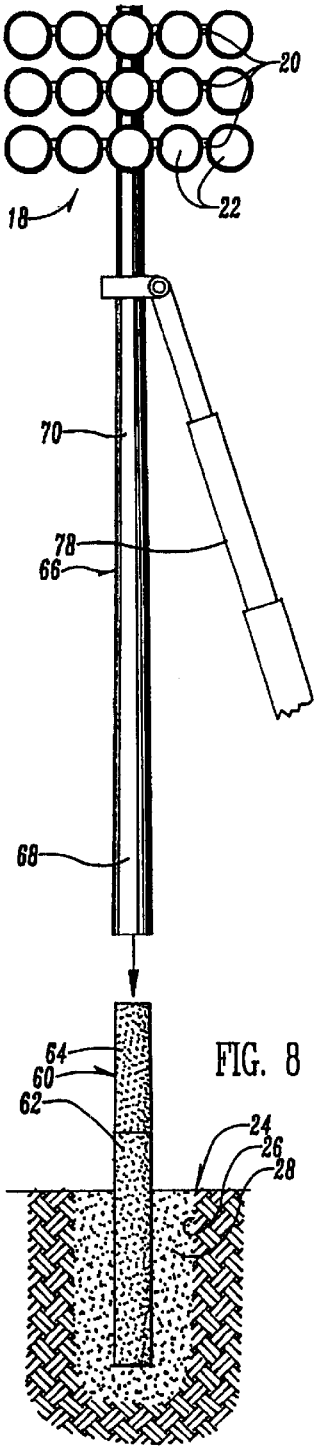
FIG. 8 is a view similar to FIG. 6 showing one method of installation of the metal pole section to the concrete base according to the present invention.

FIG. 8 depicts one method by which pole section 66 of FIG. 6 could be slip fitted onto base 60. A crane or extendable arm 78 grasping pole section 66 could maneuver it over base 60 and then slide or slip fit it down into position. It is to be understood that in the preferred embodiment, pole 66 is first gently slip fit onto base 60. Because generally light array 18 has been mounted, some rotational positioning of pole section 66 may be necessary, so that array 18 is facing in the correct direction. As one of the major advantages of the present invention, even after this preliminary installation, the pole section 66 can virtually be adjusted 360° around base 60.

Figure 9:
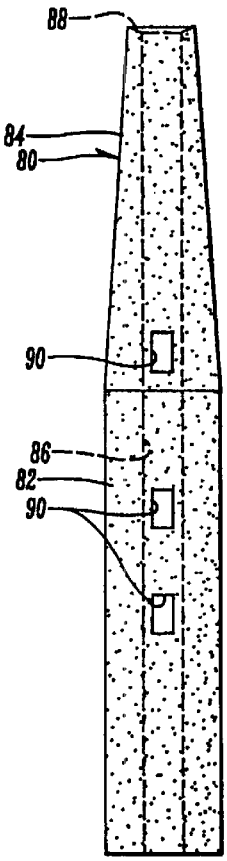
FIG. 9 is an enlarged front elevational view of one embodiment of the concrete base for the present invention.
Figure 10:
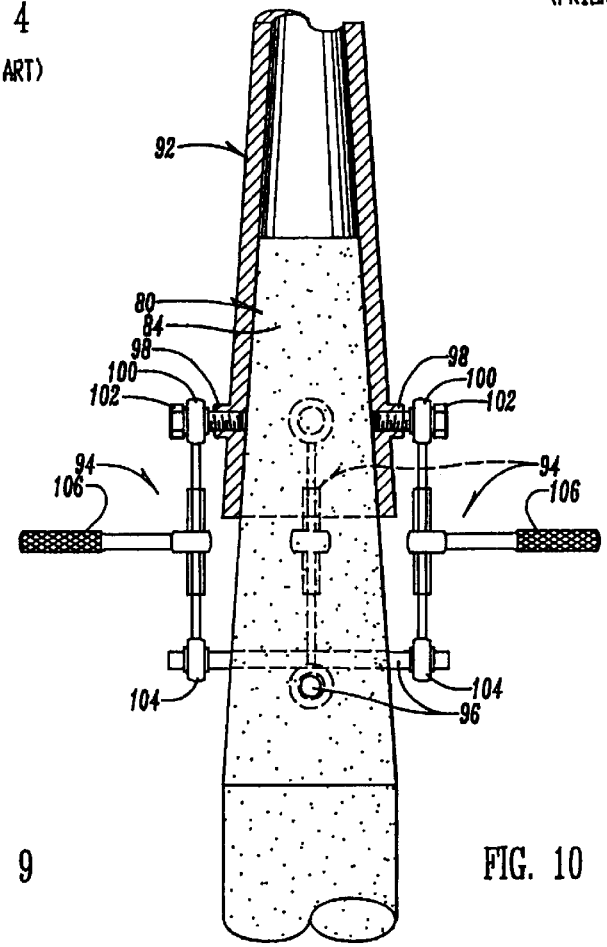
FIG. 10 is a partial still further enlarged view of an upper tapered section of the concrete base and the lower tapered portion of the steel pole section according to one embodiment of the present invention illustrating how these two elements are slip fitted together and ultimately locked together.

FIG. 9 shows in enlarged form a preferred embodiment of a base 80 according to the present invention. As can be seen, lower section 82 can be generally cylindrical in nature. Upper section 84 is basically frusto-conical and has a not very pronounced taper. Base 80 is hollowed out by bore 86 extending through it. Base 80 could be solid, however. It is particularly pointed out that at the top of upper section 84, a bevel 88 is introduced so that any moisture will run off bevel 88 down bore 86 away from the pole which will be slip fitted upon base 80. Additionally, openings 90 communicate with bore 86 to provide access for cables, wiring, and the like into the interior of base 80 and through the upper open end of base 80 into the interior of any pole section. FIG. 10 is a still further enlarged partial view of base 80 and shows a pole section 92 at least partially slip fitted onto upper section 84 of base 80. In order to pull pole section 92 further down tapered upper section 84 of base 80, and to more securely lock the pole and base together, one way to accomplish the same is to utilize ratcheting turnbuckles 94 to exert force to pull pole section 92 downwardly. A bar 96 can be inserted through a bore transversely through base 80. A nut 98 can be welded to one or more sides of pole section 92 and a bolt 100 can be threaded into nut 98. Ends 102 and 104 of turnbuckle 94 can be secured to bar 96 and bolt 100 respectively. By operation of handle 106, the turnbuckle 94 can cause downward movement of ends 102 and 104 to provide the pulling force and thus lock section 92 onto base 80.

It is to be understood that multiple ratcheting turnbuckles 94 (and nuts 98 and bars 104) could be utilized around the perimeter, or one could be connected at various positions. For example, this procedure could be used on opposite sides of pole section 92. It is to be further understood that the somewhat resilient nature of steel of pole 92 in the preferred embodiment allows some slight spreading which contributes to the resilient forces and frictional engagement of pole 92 to base 80. Therefore, no other hardware is needed for a secure junction.

Figure 11:
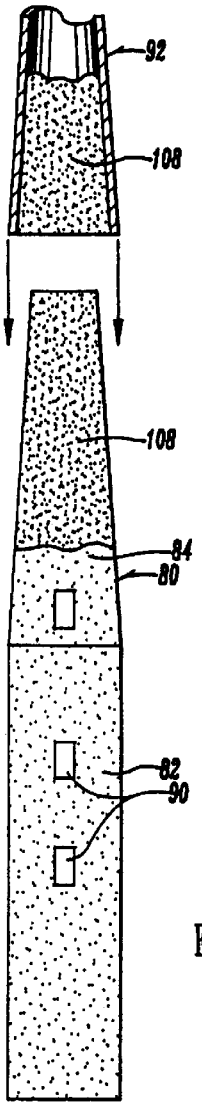
FIG. 11 is a front elevational view of a tapered concrete base and tapered lower part of the pole section according to the present invention, showing the use of a coating to assist in installation of the system.

FIG. 11, however, shows an alternative method for locking pole section 92 to base 80. Instead of requiring the use of force to pull the two elements together, a substance 108 could be coated over either the upper section 84 of base 80 or the interior of the bottom inside of pole section 92, or both. Substance 108 can be an adhesive which would first allow the initial slip fitting of pole section 92 to base 80 to provide abutment and then lock the two elements in place. The large surface area between the pole section and base when slip-fitted together allows for perhaps not quite as good adhesive to be used to accomplish its purpose compared with a joint of smaller abutting surface areas. It is to be understood that such a configuration reduces or eliminates significant gaps, pockets, or chambers at the joint. Additionally, the use of the substance 108 could completely fill any air gaps or spaces whatsoever and virtually eliminate places for water or air to work at corrosion. The ability of the semisolid or initially liquid substance to be directed to fill up all spaces allows this advantage.

It is to be further understood that substance 108 could have other advantageous properties. For example, it could have lubricating properties to facilitate easier slip fitting and 360° rotation of pole section 92. It could also have sealant properties to further resist moisture and corrosion. As an alternative, substance 108 could have any one of the above mentioned properties and be advantageously utilized with the invention. It is preferred, however, that it have at least adhesive properties. In the preferred embodiment, an epoxy substance, such as is known in the art, could be used which would bond to both steel and concrete. Alternatively, silastic (silicone), or urethane could be utilized. In general, substance 108 is applied in between a 5 to 30 mil thick coating, and generally more along the lines of a 10 mil thick coating.

This eliminates the need for jacking the two elements together, such as was explained with respect to FIG. 10, which in many applications requires up to 2000 lbs. of pressure on each side and up to 6 to 8 inches of further movement between the elements to get a secure locking fit.

It is also to be understood that to further prevent corrosion possibilities, gaskets or sealants could be used to completely seal or fill up any spaces whatsoever in base 80 or between the pole and base.

It can therefore be seen that the present invention utilizes a tapered end of the base and the tapered pole sections to allow easy and economical creation of a pole structure. To aid in an understanding of how the invention in a complicated and arduous manner provides such an advantageous combination, a short discussion of many of the factors involved in designing this combination will be set forth.

With regard to pole section 92, the following types (by no means an exhaustive list) of elements have to be considered:

1. Amount of taper.
2. Shape and diameter of pole.
3. Number of sections.
4. Number of connections.
5. Weight to strength ratio.
6. Wind load.
7. Type of steel/gauge of steel/wall thickness.
8. Stress through pole.
9. Corrosion resistance.
10. Galvanization inside and out.
11. Rotational alignment ability.
12. Transportability (length, diameter, weight).
13. Electrical or other interior connections or pieces.
14. Length of slip fit.
15. Crane or other lifting means size and availability.
16. Cost of materials.
17. Industry standards.
18. Type of structure to be suspended.
19. Installation location variables.

It is to be understood that a similar plurality of factors must also be analyzed for the base 80 (further including properties unique to concrete and its use as a support base in the ground) and the composite combination of base 80 and pole 92, as can be appreciated by those skilled in the art.

In the preferred embodiment, the taper of pole section 92 is a 0.14 inch reduction in diameter for every foot upwardly (or in other words, a small angular degree of fraction of degree inward taper). A possible range of tapers would be from 0.12 through 0.16 plus or minus 0.020 inch taper per foot of length. This is the equivalent of the previously mentioned 0.07 inch per foot taper.

The taper allows the stress experienced by the pole section to be distributed over 100% of the pole, and not necessarily concentrated in any certain areas.

While the shape of the preferred embodiment of the pole is circular in cross section, other shapes are possible where poles need not be rotated for precision alignment of fixtures after the base is set (see FIGS. 24A–24D). Base 80 has a similar or exactly identical taper to pole 92. In the preferred embodiment, the base is hollow to reduce weight and allow wiring, etc. to be brought in from the ground into the pole, and is made even lighter by utilizing prestressed concrete (more strength per pound). Wound wire is used instead of rebar. The wound wire has a tensile strength of between 250 and 275 thousand psi (pounds per square inch). The concrete base 80 is then centrifugally cast to provide a high density outside layer which is extremely strong and is more resistant to moisture penetration.

The need for the tapered joint between base 80 and pole 92 to be precise is essential. The base 90 is therefore cast in a steel die and spun for 20 minutes. It is then cured in steam for one day. Afterwards, it sits for a substantial period until it reaches its full strength.

By using this high strength concrete, the weight is reduced but the strength is retained.

It is to be understood that base 80 can be made longer for different soil conditions and can be made longer and wider for different heights and stress conditions for poles. Generally in the preferred embodiment, upper section 84 of base 80 is somewhere around 7 to 8 feet in length. Because of the long overlap for the slip fit joint (generally the 7 to 8 feet for 7 to 8 feet upper section 84), this comprises a relatively low stress joint because it involves substantial surface area contact and overlap length between members. There are no welds, bolts, or any other hardware in this joint area (which can weaken the joint or present focused stress points). Additionally, it is above the primary corrosion zone by remaining two or more feet above the ground. Additionally, the thickness of pole section 92 is the same throughout its length and therefore it is easier to reliably galvanize the steel.

It is therefore crucial to understand that when designing and manufacturing the components for the invention, a variety of different design considerations are taken into effect. However, the advantage of the present invention is that they can be analyzed and contemplated during design and then pre-manufactured to allow an entire unit (pole section(s) and base) to be shipped together (along with fixtures and arrays). Quality control over all of the elements can be more easily accomplished.

The problems with shipping with prior art devices have been previously discussed. As can be seen in these preferred embodiments, the lower weight of the prestressed concrete base 80, the lower weight of the hollow pole section 90 and any additional sections, as well as the ability to section the pole (if needed) allows for better flexibility and more economical shipping.

The additional advantages of the invention can be seen with respect to installation on site.

Figures 22, 23, 24A, 24B, 24C, 24D, 25:
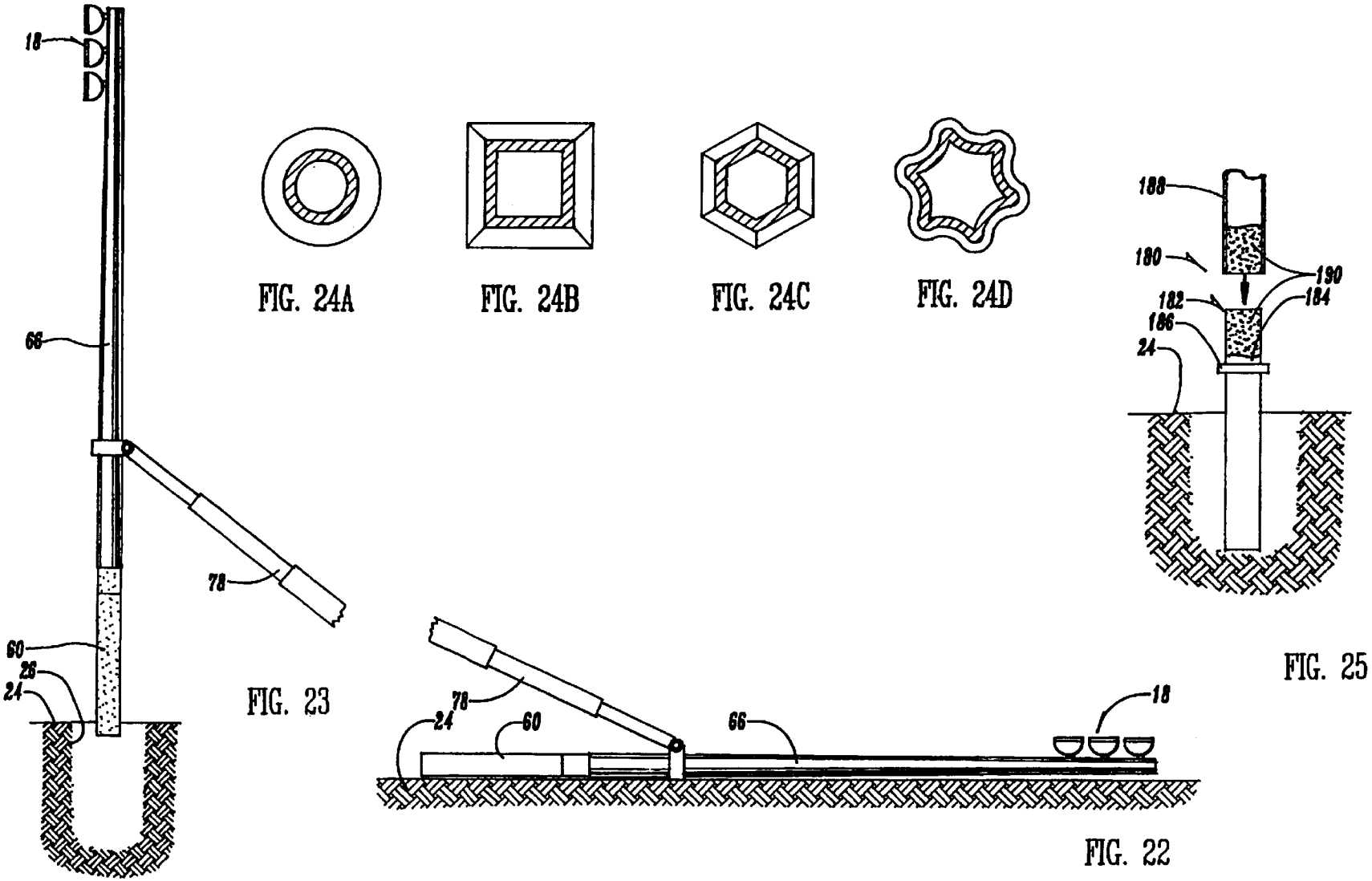
FIGS. 22 and 23 are side views depicting a method for pre-assembling and installing a pole system according to the present invention.
FIGS. 24A, 24B, 24C, and 24D are cross sectional view of alternative pole structures that can be utilized according to the present invention.
FIG. 25 is a depiction of an alternative embodiment of the present invention where the base member and the pole section do not have matching tapered portions, but slip fit together until abutting a stop member.

It is to be understood that one way to assemble and install a pole system according to the present invention would be to preassemble base 80 and any pole sections 92 horizontally on the ground or otherwise, and then utilize a crane or similar device to pull the combination upright and insert it into the excavated hole. Then dirt, rock, or concrete could be poured around base 80 to set the combination in place. Such a process is schematically depicted at FIGS. 22 and 23. It is to be understood that various disadvantages of this method have been previously discussed. One advantage of the present invention, however, is that a majority of the weight of the combination is in base 80. Therefore, the crane or other device would be able to grip the assembly at a lower point (i.e., towards the center of gravity of the assembly). From a practical viewpoint, this allows use of a smaller crane or other machine which significantly reduces cost if the crane were rented or otherwise leased.

Secondly, flexibility of the invention can be seen in that the base 80 could first be anchored in the ground and made plumb, and then the pole sections can be slip fitted into place in any manner desired. This would be done, preferably, by setting the base 80 in concrete to avoid the unreliable backfill of rock or dirt. Generally, the pole sections would be preassembled and then the entire structure would be slip fitted to base 80. This produces a reliable, rigid installation and alignment.

Figure 12:
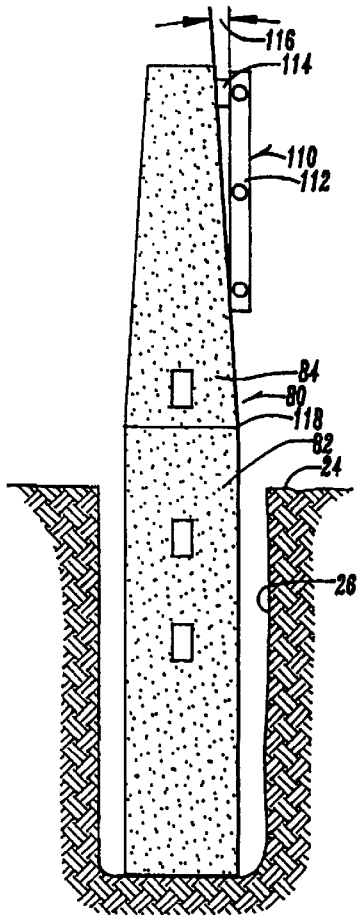
FIG. 12 is a front elevational view of a base member according to the present invention positioned in an excavated hole for anchoring in the ground, further showing a leveling or plumb means used to insure the base is plumb or vertical during installation.

A number of advantageous methods have been developed to facilitate this type of installation. First, as shown in FIG. 12, base 80 can be, by means known within the art, set within excavated hole 26 so that it rests on the bottom of the hole. A level means 110 comprised of an elongated linear level 112 (in this case four feet long) with a transversely extending foot 114 can be utilized in the position shown in FIG. 12 to level or plumb base 80. Foot 114 would be of a transverse length (approximately ¼" for a 4 foot long level and a 0.14 inch taper per diameter for every foot) so that knowing the taper of upper section 84 of base 80, when placed against the taper in the position shown in FIG. 12, level 112 will read that base 80 is vertical along its longitudinal axis only when level 112 is vertical. In other words, the tangent of the angle 116 formed between level 112 and tapered side of upper section 84 would equal the length of foot 114 divided by the length of level 112. Level means 110 can be moved around the perimeter of upper section 84 to insure it is plumb in all directions. This leveling process could take place as concrete or other fill is put into hole 26 and such sets up. Then the verticality of any pole sections 92 slip fitted onto base 80 is assured. It is also to be understood that level 112 could be used with other installation methods.

Figure 13:
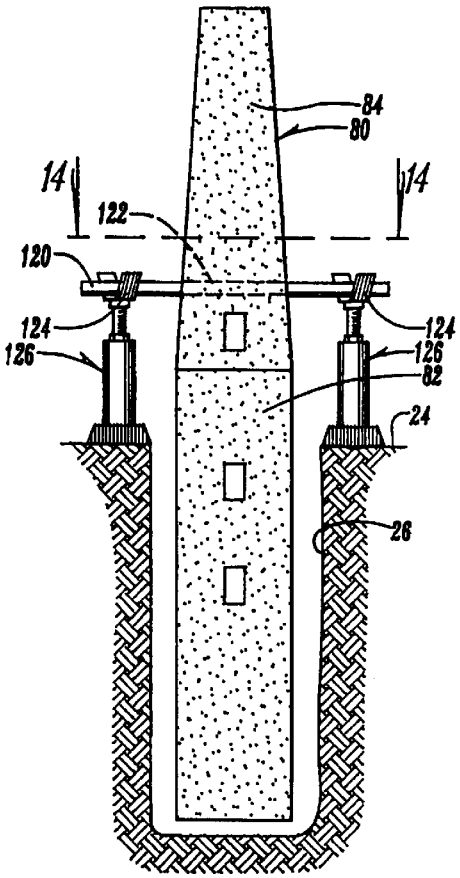
FIG. 13 is a front elevational view similar to FIG. 12 showing an alternative combination for leveling or plumbing the base member.

FIG. 13 shows an alternative method to level or plumb base 80 (especially when base 80 is not, or cannot be set on the bottom of hole 26). It is to be understood that a slurry is preferred to be used to keep base 80 plumb during pouring of the concrete. A bar 120 inserted through a lateral bore 122 which is generally perpendicular to the longitudinal axis through base 80 could be utilized to sit into V-brackets 124 of screw jacks 126 on opposite sides of base 80. In a pendulum like manner, base 80 could swing around bar 120 (the bottom of the base would not touch the bottom of excavated hole 26) to find its plumb position in that plane (a vertical plane through the longitudinal axis of base 80 and extending generally perpendicular to a vertical plane through bar 120). This allows for setting base 80 in holes deeper than base 80 or holes with a soft bottom which would not support base 80. Screw jacks 126 could then be adjusted and utilized with a conventional level on bar 120 or with respect to base 80 to insure that base 80 is level in the plane through the axis of bar 120 parallel to the page at FIG. 13. Alternatively, one side of bar 120 could be blocked to a certain height and then one jack 126 could be used to level the other side. Additionally, a rebar cage could be added to base 80 and extend to the bottom of hole 26, or more concrete could be added to fill up hole 26 under base 80.

Figure 15:
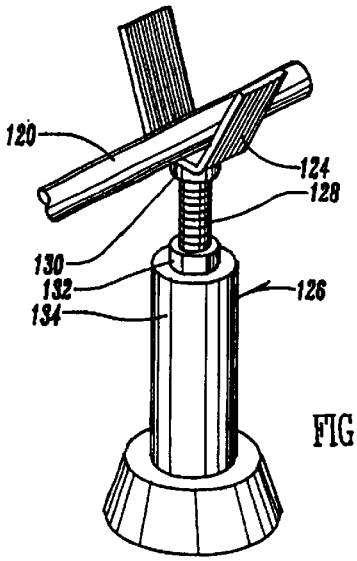
FIG. 15 is a perspective view of a leveling jack depicted in FIGS. 13 and 14.

FIG. 15 shows screw jack 126 in more detail. V-brackets 124 are rotatably mounted to screw rod 128. A nut 130 is rigidly secured to bracket 124 and screw rod 128 which is threadably mounted in nut 132 rigidly secured to base 134. By turning nut 132, screw rod 128 rotates and moves up and down in base 134.

Figure 16:
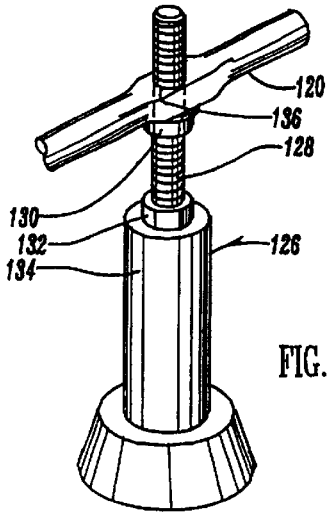
FIG. 16 is a perspective view of an alternative embodiment for a leveling jack.

FIG. 16 shows an alternative jack means that could be used in the embodiment of FIG. 13. Bar 120 could have an aperture 136 extending therethrough. Instead of V-brackets 124, screw rod 128 could simply extend through aperture 136. This time, by turning nut 130, bar 120 would be raised or lowered.

Figure 14:
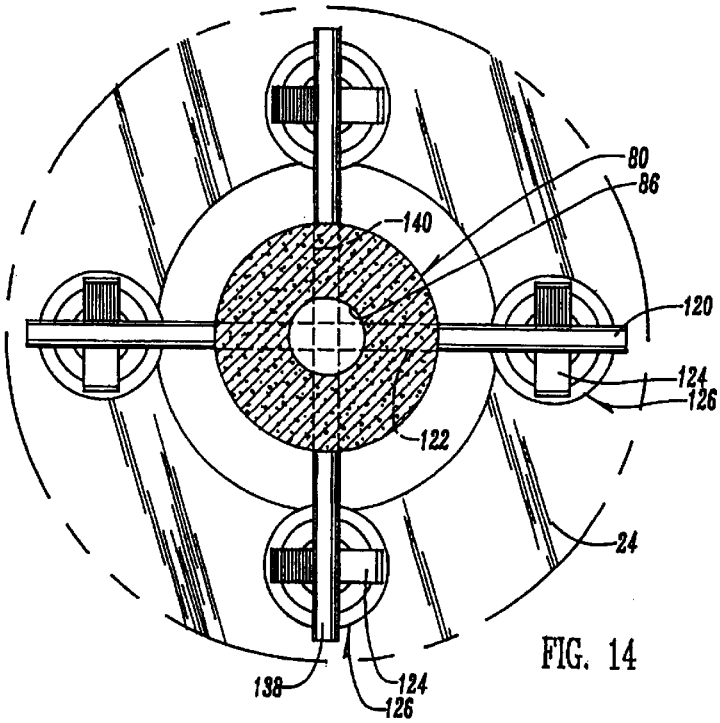
FIG. 14 is a sectional view taken along line 14—14 of FIG. 13, but including an additional cross bar through the base member and two additional leveling jacks from that illustrated in FIG. 13.

FIG. 14 shows an alternative embodiment to FIG. 13. To prevent base 80 from moving in any direction in excavated hole 26, an additional bar 138 could be inserted through an appropriate transverse bore 140 (close to but spaced from bore 122) through base 80 but in a perpendicular direction to bar 120. As shown in FIG. 14, additional screw jacks 126 would hold bar 138. All screw jacks 126 could be adjusted to level or plumb base 80. By utilizing the two bars, however, base 80 would be locked into position. Therefore, when pouring concrete or other material into hole 26, could not be easily moved out of alignment base 80.

Figure 17:
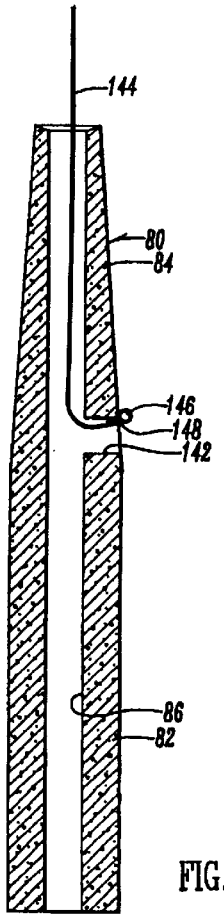
FIG. 17 is a sectional elevational view of a base member according to the present invention illustrating a means for lifting and positioning the base member within an excavated hole in a generally plumb position.
Figure 18:
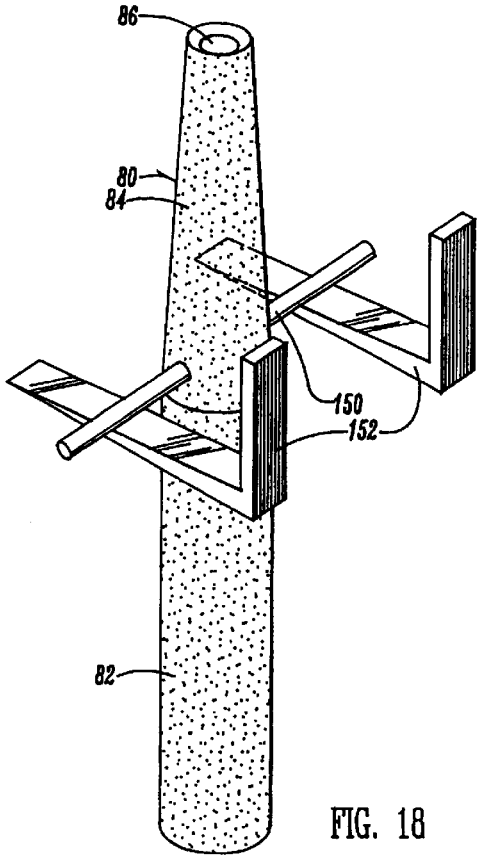
FIG. 18 is a partial perspective view of the base member according to the present invention showing means for a forklift to lift and position a base means in an excavated hole in a basically plumb position.

The FIGS. 17 and 18 show two further methods for installing base 80 into hole 26 in a plumb manner. In FIG. 17, an aperture 142 from the exterior of base 80 into bore 86 would allow a strap 144 connected to a crane or other machine to be inserted and threaded out aperture 142. A locking pin 146 could be slipped through loop 148 in the end of strap 144 to hold strap 144 in the position shown in FIG. 17. By virtue of suspending base 80 in the manner shown in FIG. 17, it would basically find its plumb position when lowered into hole 26.

In FIG. 18, a bar 150 is inserted transversely through base 80. This would allow a forklift 152 to raise base 80 and again it would act somewhat like a pendulum, at least in one plane to find its basically plumb position. The forklift can be maneuvered to keep base 80 plumb during backfill with concrete. Once the concrete is poured to top of hole 26, the forklift can be removed as concrete will support the weight of base 80 and keep it level.

Figure 19:
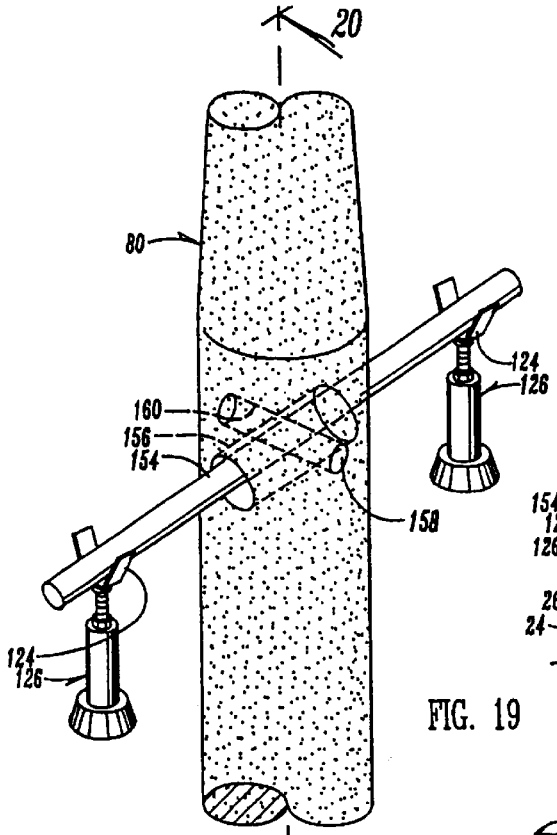
FIG. 19 is a partial perspective view of a still further embodiment for leveling and plumbing a base member in an excavated hole.
Figure 20:
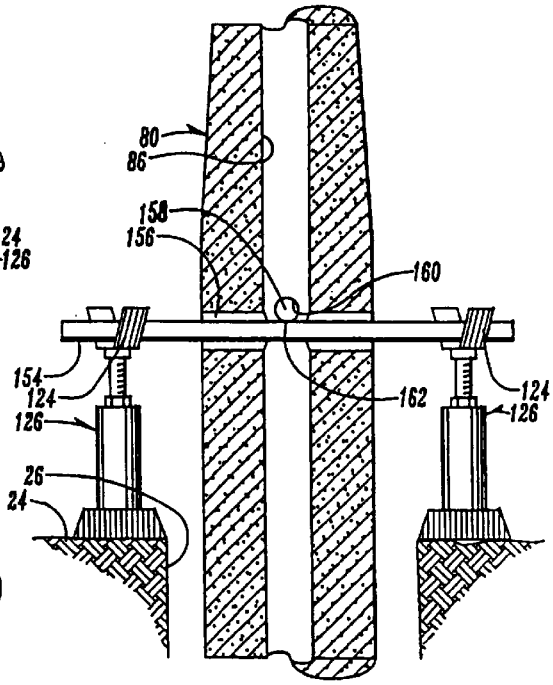
FIG. 20 is sectional view taken along line 20—20 of FIG. 19.
Figure 21:
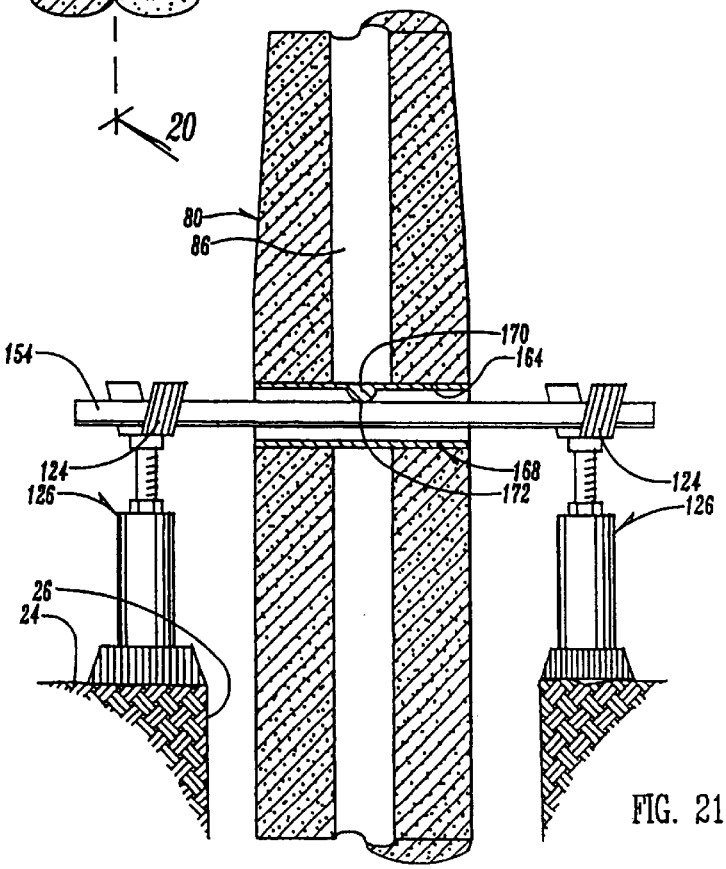
FIG. 21 is a still further alternative embodiment for a leveling or plumb means for the present invention.

FIGS. 19–21 show two additional, more intricate methods for plumbing base 80 in hole 26. In FIG. 19, a long bar 154 is inserted through an oversized bore 156 so that there is some play if base 80 were tilted in a vertical plane through bar 154. A short bar 158 is inserted in a bore 160 perpendicular to bore 156 but partially intersecting bore 156. As can be seen in FIG. 20, bar 158 would rest upon bar 154. Essentially, the abutment point 162 between bars 158 and 154 would be a small intersection of two rounded surfaces. Thus, base 80 would be able to tilt by the forces of gravity in virtually any direction. Abutment point 162 acts somewhat like a knife-edge balance point and allows base 80 to automatically plumb itself to the extent it is free to tilt in the setup. Screw jacks 126 can be utilized to roughly plumb base 80. A fluid slurry mix of concrete can be poured to allow base 80 to remain plumb.

FIG. 21 shows a modification of this self plumbing setup. To avoid having two transverse bores through base 80, FIG. 21 utilizes a large bore 164 in which a sleeve 168 is positioned. A rounded raised member extends from the interior center of the sleeve 168. Bar 154 and jacks 126 can then be configured as shown so that bar 154 extends through sleeve 168. the abutment point 172 between member 170 and bar 154 again acts as a knife-edge balance point to allow base 80 to plumb itself.

After installation by any of the above methods, the invention in its assembled form presents a pole having accurate and reliable anchoring in the ground, has sufficient strength in both the base and the pole sections, and is resistant to corrosion in the base and in the pole sections. It provides the preferred steel upwardly extending pole without the disadvantages of conventional steel poles. The invention therefore provides a long lasting durable pole, which impacts on the cost of such poles over their life spans.

It will therefore be appreciated that the present invention can take many forms and embodiments. The true essence and spirit of this invention are defined in the appended claims, and it is not intended that the embodiment of the invention presented herein should limit the scope thereof.

A primary example of an alternative embodiment according to the invention can be seen at FIG. 25. Embodiment 180 consists of a base 182 and pole section 188 similar to those previously described. However, base 182 has a straight (not tapered) top section 184. A stop member 186 extends laterally from base 182. Pole section 188 is also a straight-sided (not tapered) tube pole. It can be slip fitted onto top portion 184 of base 182 until it abuts stop 186. Epoxy 190 can be coated on both the exterior of base 182 and interior of pole 188 to assist in bonding the two. Sealant can also be used. It can be seen that pole 188 is again held above ground. This embodiment is particularly useful for square or multi-sided poles, that do not require or are not desired to be tapered.

It is also to be understood that the pole sections are preferred to be made of steel but other materials are possible, for example, aluminum.

As can be seen by referring to the prior art design in FIG. 5, the presently claimed invention completely eliminates all the problems associated with potential corrosion, stress, and even vandalism of the nuts, bolts, joint, and overall structure of that prior art embodiment, even though in the prior art design of FIG. 5, concrete is utilized in the ground, the metal is attempted to be galvanized, and grout or other sealant is attempted to be placed around the base/pole joint.

In order to achieve a better understanding of other aspects of the invention, a detailed description of a preferred embodiment depicted in FIGS. 26–46 will now be set forth. Reference numerals are utilized in the drawings to indicate parts and locations in these drawings. The same reference numbers will be used in all these drawings for the same parts and locations unless otherwise indicated.

This detailed description will first discuss an example of a total integrated lighting installation according to the invention. Thereafter, specific features will be discussed. Finally, the operation, methods and processes involved with this structure and features will be described, along with examples of possible enhancements, alternatives, or additions.

Figure 26:
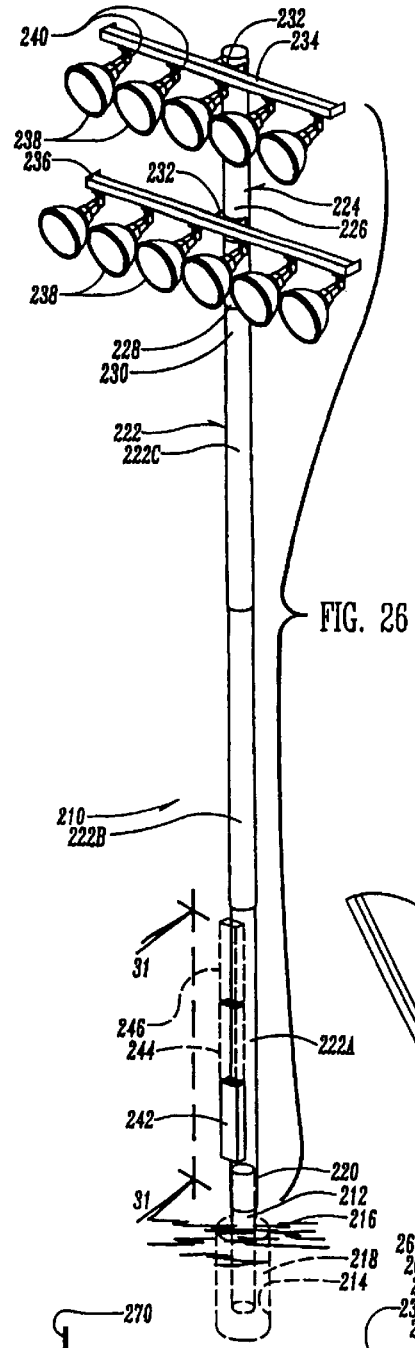
FIG. 26 is a perspective depiction of a complete embodiment of a lighting installation according to the invention.

Referring particularly to FIG. 26, a lighting installation 210, according to the present invention, is depicted. A rigid base 212 is secured in a vertically plumb position in hole 214 in ground 216. In this preferred embodiment, base 212 is made of a prefabricated, prestressed concrete that can be shipped on-site and installed in hole 214 according to methods similar to those described previously. One method is to insert base 212 in hole 214, and hold it plumb. Liquid fill (preferably concrete) is then filled around base 212 in hole 214 and allowed to at least partially set. Base 212 is kept plumb while the concrete sets up thereby insuring a vertically plumb base.

Base 212 has a tapered upper end 220 upon which can be slip-fit onto pole 222. It is to be understood that in this embodiment, pole 222 is made up of sections 222*a*, 222*b*, and 222*c*, each being tapered along its length and each being slip fitable upon the other, as has been previously described. Because of the accurate positioning of base 212, sections of pole 222 also can reliably be installed in a plumb orientation. It is to be further understood that there are various ways to erect the pole sections onto one another; one way is to assemble pole sections 222*a* through 222*c* on the ground, and then lift them by crane to slip fit over upper end 220 of base 212. Also note that once positioned on base 212, pole 222 can be rotated for accurate rotational orientation of the pole, before it is secured in place. This is a highly advantageous feature of this invention.

In the embodiment of FIG. 26, an advantageous feature is the utilization of pole top 224. A center piece 226 has a tapered bottom end 228 which is slip fitable over the upper most tapered end 230 of pole section 222*c*. Extensions 232 extend perpendicularly from the axis of center piece 226 and at the outer ends are mounted cross arms 234 and 236, which are perpendicular to the outwardly extending axis of extensions 232 as well as the axis of center piece 226.

This unitary pole top 224 allows attachment to pole 222 easily and quickly, whether on the ground, or once pole 222 is erected. All components of pole top 224 are pre-manufactured. No separate installation of extensions 232 or cross arms 234 or 236 is required. This framework is all calibrated during manufacturing so that the exact relationship geometrically between those parts is known. Therefore, when pole top 224 is attached to pole 222, a three dimensional axis is in place and pre-defined because all parts are orthogonal. As will be discussed in more detail later, lighting fixtures 238 (as shown in FIG. 26) have adjustable joints 240, and can also be pre-installed on pole top 224 either prior to shipment, or on-site on the ground. The joints 240 can be adjusted to predetermined aiming angles because of the known, fixed orientation of cross arms 234 and 236 to center piece 226.

FIG. 26 also shows how ballast boxes 242, 244, and 246 can be mounted on lowest pole section 222A, some distance off the ground, but in an easily serviceable location.

As can be appreciated, lighting installation 210 can be erected very quickly with a minimum amount of labor and machinery. Its components can be manufactured efficiently and economically, allowing great flexibility in the design of the actual installation for various uses. The various components of installation 210 allow it to be shipped economically and efficiently, with a minimum amount of custom installation on site. It is particularly pointed out how the entire installation can be pre-planned, and partially assembled at the factory. It then can be installed with a minimum risk of mistakes for reliable operation. Finally, it is configured to allow for easy maintenance.

These features encompass all of the lighting fixtures, pole and structural supports, and electrical components, as will be set forth in more detail below.

Figure 27:
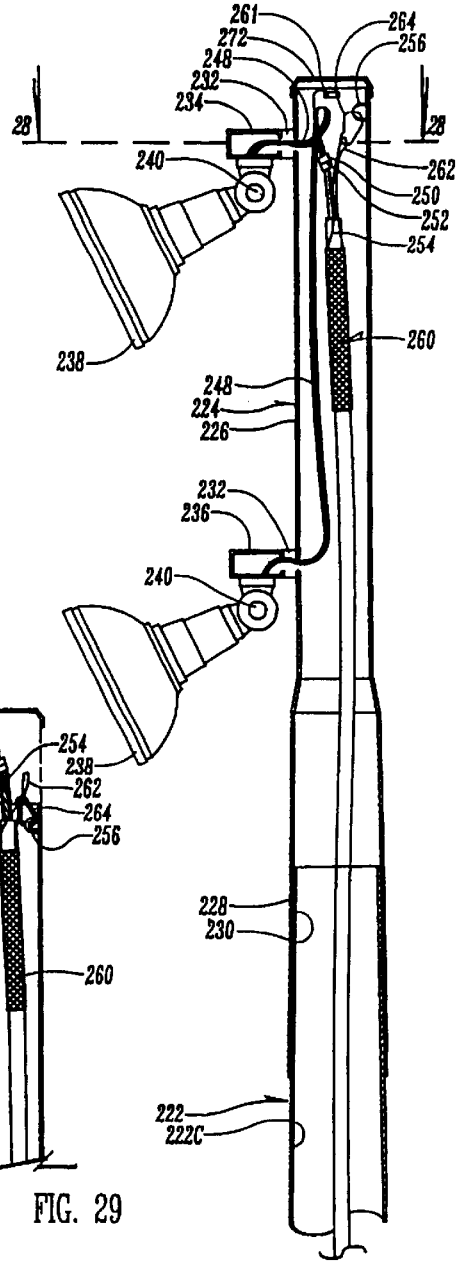
FIG. 27 is an enlarged side sectional view of the top part of the embodiment shown in FIG. 26.

FIG. 27 depicts in enlarged cross-sectional detail pole top 224. It also illustrates internal wiring components that comprise an additional advantageous feature of the invention. As can be seen, center piece 226, extensions 232, and cross arms 234 and 236 are generally hollow. The prefabrication of those three components at the factory includes openings between the various elements so that wiring can be communicated throughout those components. This allows for significant amount of prewiring of the light fixtures 238 at the factory.

FIG. 27 further shows how extensions 232 space cross arms 234 and 236 away from center piece 226. This allows joints 240 and fixtures 238 to be positioned anywhere along cross arms 234 or 236, including directly in front of center piece 226. This subtle feature allows great flexibility in placement of lighting fixtures 238 which can advantageously impact a variety of factors, including the number of fixtures per cross arm, a reduction in cross arm length, and even the aesthetic appearance of the lighting array. For example, in FIG. 26, cross arm 234 is shown with five lighting fixtures 238. One fixture is directly in front of middle section or center piece 226. Cross arm 236 is shown with six lighting fixtures. Conventionally, the lighting fixture could not be easily installed directly in front of a pole. The present invention allows this and therefore five fixtures could be placed on a cross arm of shorter length than conventional, which gives more aesthetic uniformity to the fixtures, and can even reduce the amount of material needed, and hence, the material costs for the bar. The ability to place fixtures directly in front of the pole also makes it easier to reach and maintain those fixtures, as well as others, which will be closer to the pole.

FIG. 27 shows the tapered bottom end 228 of pole top 224 and how it slip fits in mating fashion over the upper most tapered end 230 of pole section 222C. As previously described, the tapers are closely conformed to allow a secure and rigid fit. Adhesives or other coatings can be used between the members, such as lubricants or sealants. Again it is to be understood that once pole top 224 is somewhat slip fitted onto tapered end 230, it can still be rotationally oriented.

FIG. 27 also illustrates the easy pre-configured wiring in pole top 224. Wires 248 are communicated to each lighting fixture 238 to supply electrical power to the lamps (not shown) in those fixtures. Each of the wires 248 terminates in a connector 250 which can be plugged into a mating connector 252 which is the terminal for a bundle of cables 254 that extends down the interior of pole top 224 and pole 222. Connection of cables 254 to wires 248 merely entails plugging connectors 250 and 252 together.

FIG. 27 additionally shows how the cabling arrangement can be secured inside of pole top 224. A U-shaped hook 256 having both free ends secured to the interior of center piece 226 of pole top 224 provides an anchor for hanging cables 254. In the preferred embodiment, cable grip 260 (preferably a "KELLUM GRIP", available from FLEXCOR) surrounds cables 254 and has a loop 262 extending therefrom. A snap ring 264 can then be connected between U-shaped hook 256 and loop 262 to securely and reliably suspend the top of cables 254 in the position shown. In comparison, normally a J-shaped hook is used on the interior of the pole which can result in loop 262 or any other connection means to be dislodged from the hook. In other words, the components of the invention provide completely enclosed connecting members which provide a positive secure attachment.

It is important that a reliable securement and support of cables 254 be accomplished to eliminate any cable strain on wires 248, connectors 250 or 252, or cables 254. Additionally, this assists in the longevity of the wiring as well as the positioning of the wiring for minimum abrasion or trauma with the inside of the pole.

As can be further appreciated, this reliable suspension of cables 254 allows for the wiring and cabling to be precut and configured with connectors so that the cabling is neither too long or too short and the easy connection can be made. Moreover, a ground connection lug 261 can be positioned inside pole top 224 to allow easy access to a ground terminal. Also note that both bundles of cables 248 and 254 can be secured to the U-shaped hook 256 for strain relief, if desired.

Figure 28:
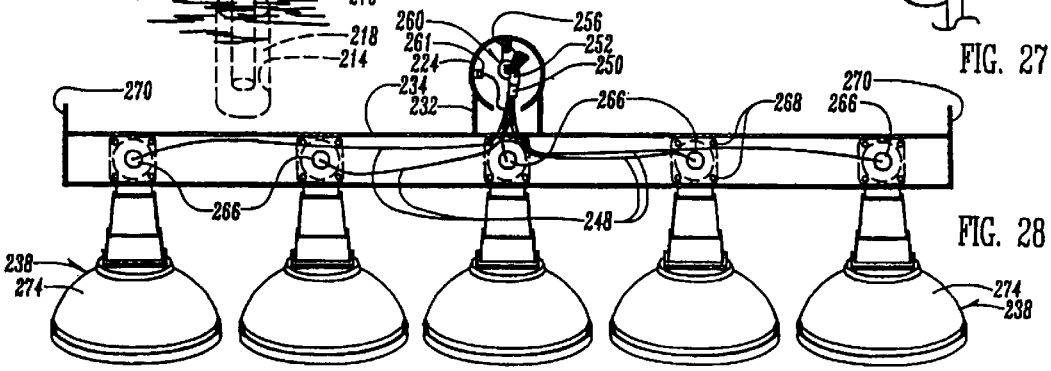
FIG. 28 is a top sectional view taken along line 28—28 of FIG. 27.

FIG. 28, a top sectional view taken along line 28—28 of FIG. 27, shows in further detail this arrangement. In this Figure, apertures 266 in the bottom of cross arm 234 can be seen allowing access of wires 248 to light fixtures 238. Additionally, bolt holes 268 surround each aperture 266 in cross arm 234 to allow the quick and easy installation of light fixtures 238 to cross arm 234. It can also be seen that cross arm 234 has ears 270 at opposite ends. These ears have apertures which allow the connection of a platform or cage to the cross arms for maintenance purposes, if needed, or for securement during crating and shipping.

FIG. 28 also shows how the U-shaped hook 256 and cable grip 260 can be generally centered inside of pole 222.

Figure 29:
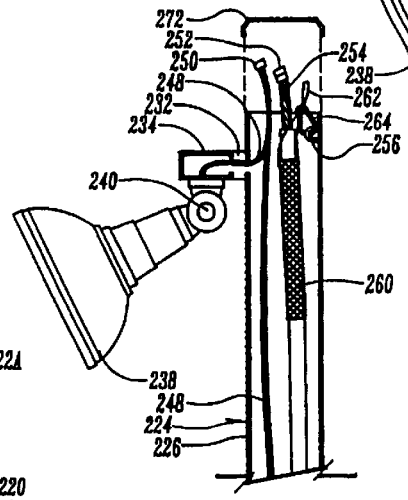
FIG. 29 is a partial view of the top part of FIG. 27 illustrating the removable top cap of the embodiment.

FIG. 29 is an isolated sectional detail of the upper portion of pole top 224 illustrating the ease of connection of wires 248 to cable bundle 254. A removable cap 272 on the top of pole top 224 allows easy access to connectors 250 and 252 so that cable bundle 254 can be supported from hook 256 and connectors 250 and 252 can be plugged together. Cap 272 is then repositioned by means well within the skill of those with ordinary skill in the art (for examples screws, set screws, or the like), and the electrical connection is completed.

Figures 30, 34:
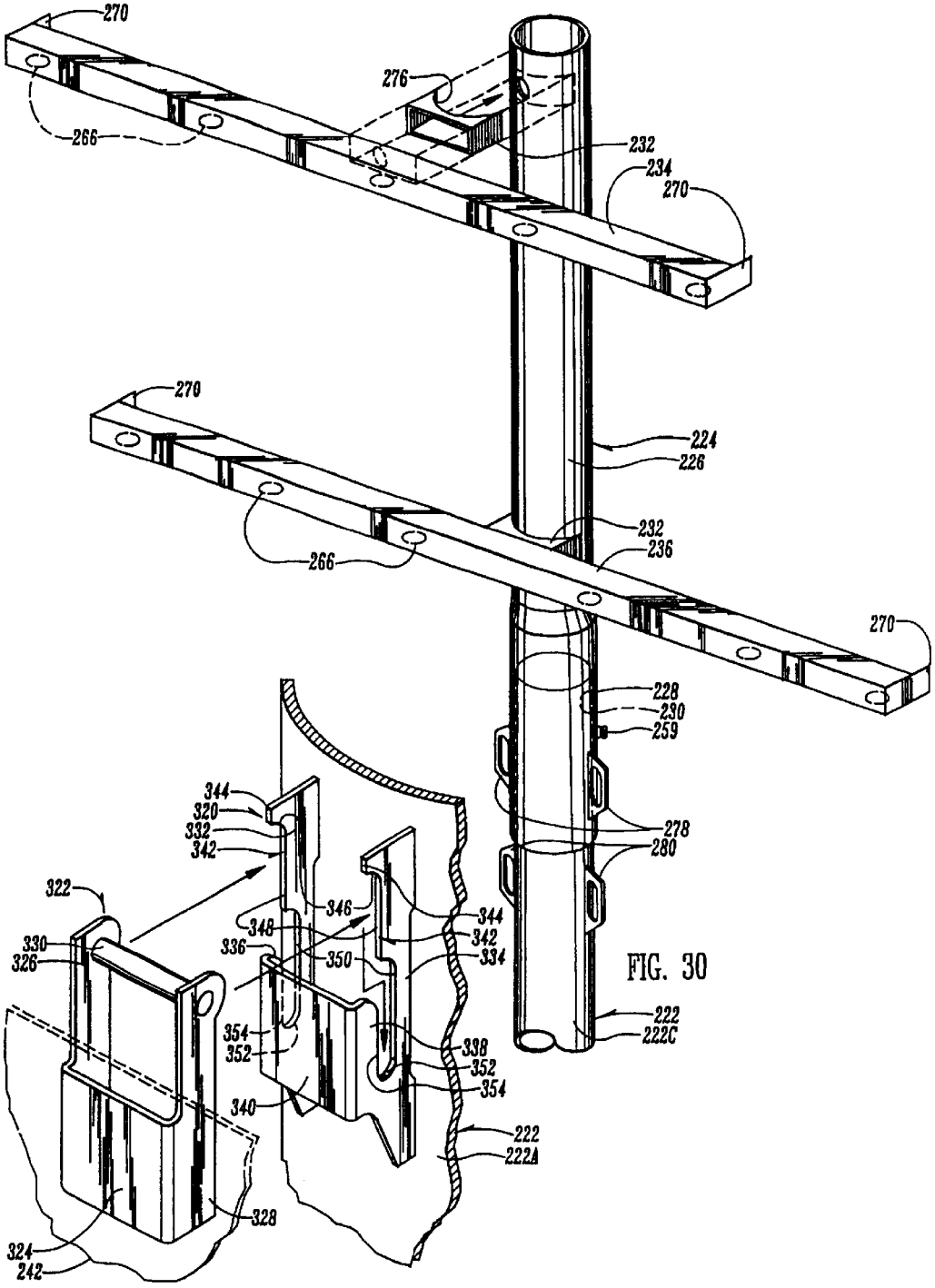
FIG. 30 is an enlarged perspective and partial exploded view of the upper portion of the embodiment of FIG. 26.
FIG. 34 is an isolated, enlarged, exploded perspective view of attachment brackets for a ballast box to a pole according to the invention.

FIG. 30 shows in isolation, and in partially exploded fashion, pole top 224. This Figure further emphasizes the fact that normally the spacing of aperture 266 will be equal. There is usually a minimum distance determined by the width of the reflectors 274 (see FIG. 28). This ties in with the discussion regarding how many fixtures can be supported by each cross arm.

Furthermore, the exact shape of extensions 232 can be seen. A radius cut 276 at one end of the extension mates with the arc or curvature of the center piece 226 of pole top 224 at that location.

FIG. 30 furthermore shows ears 278 on the exterior of the lower tapered bottom end 228 of pole top 224, in comparison with ears 280 on the upper most tapered end 230 of pole section 222C. These ears can be utilized to connect jack means (not shown) between each pair of ear 278 and ear 280 on opposite sides to jack top 224 onto pole section 222*c* for the secure fit. Again this can be done on the ground, or when elevated, but consists of a easy yet reliable connection between those pieces. It is noted that ears 280 are positioned far enough down the pole section 222C to allow upper most tapered end 230 to be inserted within bottom end 228 of pole top 224 a substantial distance for a preliminary fit. The jacking between the two sections accomplishes the final rigid fit between the pieces. Once fitted into final position, a set screw 259 could be used to further insure against movement or rotation.

Figure 31:
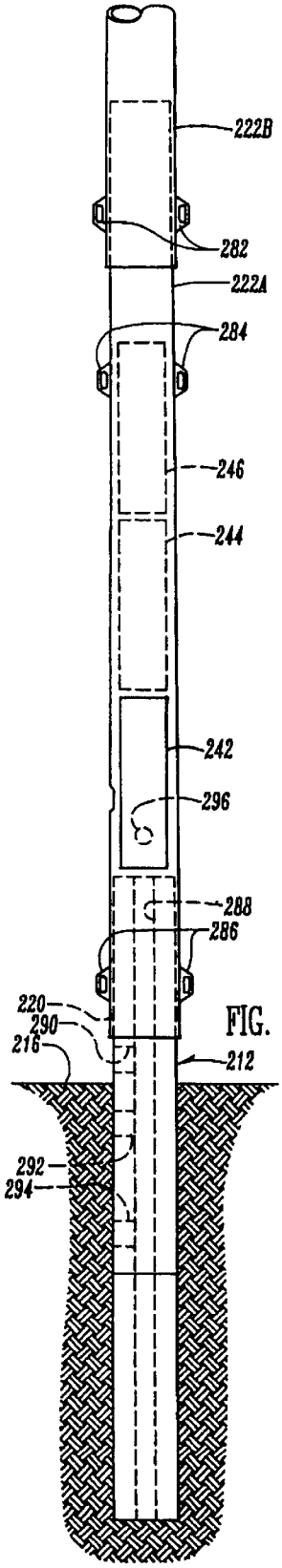
FIG. 31 is an enlarged front elevational view and partial sectional view taken generally along line 31—31 of FIG. 26.

FIG. 31 depicts several things First, it depicts ears 282 and 284 on pole sections 222B and 222A respectively. These ears are used in the same manner as ears 278 and 280, to jack the two tapered pole sections together. Ears 286 can also exist at the bottom of pole section 222A for a similar purpose. A connection means on base 212 would have to be established and then jacks attached between ears 286 and that connection means.

FIG. 31 also shows in more detail base 212. It is important to understand that a hollow channel 288 exists in base 212. One or more perpendicular openings (in FIG. 31 openings 290, 292, and 294) communicate with channel 288. Opening 290 is above ground level; openings 292 and 294 are below. Any of the openings allows cabling from the electrical power source to enter the base 212 and then extend upwardly through channel 288 into the hollow interior of pole 222. Any openings 290, 292, and 294 not used can be sealed up.

FIG. 31 also shows an opening 296 in the side wall of bottom section 222A of pole 222. This allows communication of the electrical wires within pole 222 to such things as ballast boxes 242, 244, and 246. In the preferred embodiment these ballast boxes are positioned several feet above ground level, but near enough to ground that they can be easily accessed and serviced. For ease of manufacturing and installation, only one opening 296 is ordinarily required in pole 222. Electrical communication between ballast boxes 242, 244 and 246, can be between adjacent ends of those boxes.

Figure 32:
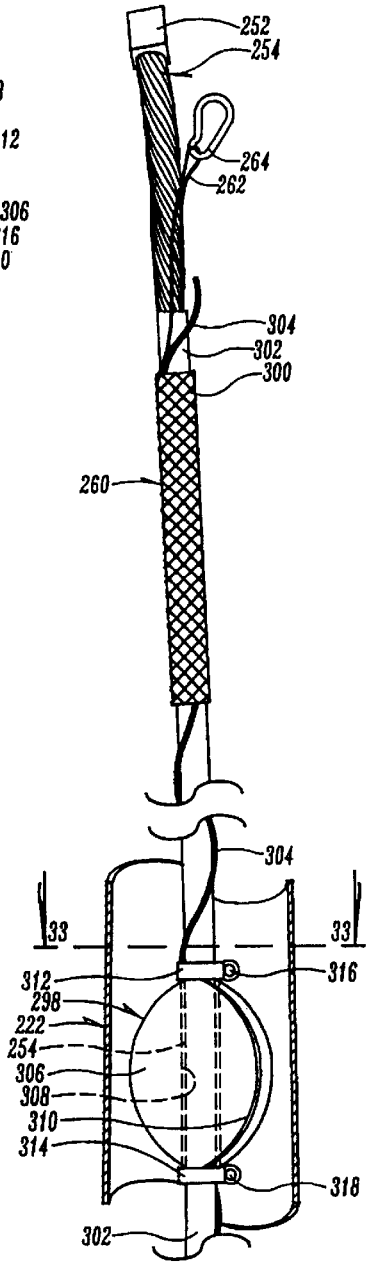
FIG. 32 is an enlarged isolated view of electrical cabling and associated components according to the invention.

FIG. 32 shows in enlarged detail cable grip 260 previously described. It also shows the enhanced features of a particular bundling of cables 254 as well as an abrasion reducing means 298. Cable grip 260 basically consists of a somewhat flexible wire mesh cage 300 that can be expanded to slip over cabling. Strands from the cage form loop 262 to which can be attached snap ring 264 according to the preferred embodiment. Once snap ring 264 is connected to U-shaped hook 256 (see FIG. 27) on the interior of the pole, the weight of cables 254 within wire cage 300 elongates and narrows cage 300 causing it to grip cables 254 and be secure at that location along cables 254.

Although this type of wire grip is well known in the art, it is proved to have certain deficiencies when applied to the present use. For example, many times a large number of wires need to be communicated from the lighting fixtures down the pole means. The wire cage 300 has to have a secure grip and hold such a group of wires in place. Those wires in the center, based simply on gravitational weight, tend to slide or slip and move downwardly, as opposed to the wires around the circumference which directly are in contact with the wire cage 300. This can cause significant problems. This is particularly true when applied to installations where the wiring is tens of feet tall.

Moreover, the wire cage 300 can dig into the insulation surrounding cables 254 over time, helped by the gravitational weight of the cables. As was previously mentioned, in the prior art loop 262 generally is simply placed over a J-shaped hook which presents the risk of the loop coming undone or being dislodged.

In the present invention, several steps are taken to eliminate these problems or deficiencies. First of all, the cluster of cables 254 are twisted to provide a helix along their entire length, as shown in FIG. 32. This eliminates or greatly reduces the risk that interior wires will slide downwardly with respect to other wires of the cluster. Secondly, an abrasion resistant sheath 302 (such as rubber) encapsulates the twisted cables 254 along its entire length. Finally, a line 304 is wrapped around the sheath 302. The wire cage 300 of the cable grip 260 is then inserted over the line 304 and sheath 302. This eliminates or reduces the risk of digging into the insulation of cables 254 themselves. Sheath 302 is also an anti-slip cover to allow better gripping by cage 300.

Figure 33:
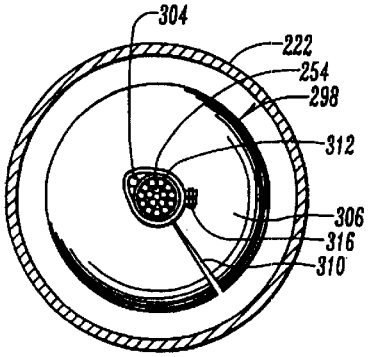
FIG. 33 is a sectional view taken along line 33—33 of FIG. 32.

FIG. 32, in conjunction with FIG. 33 depicts abrasion reducing means 298. To prevent trauma to cables 254 by swinging against the inside of pole 222 along its length, which can abrade or otherwise cause damage to the cabling, abrasion reducing means 298 are positioned at spaced apart locations along cables 254 (generally every 15 feet. The device 298 basically includes a body 306 having an interior channel 308. Body 306 could be of a number of different shapes (for example, football shaped, round, etc.) and is preferably hollow (for example ⅛ inch hollow rubber body). Body 306 has a slit 310 which allows it to be opened sufficiently to be inserted so that channel 308 surrounds cables 254. It is preferred that body 306 be somewhat resilient and shock absorbing. Also, the lateral diameter of body 306 should extend substantially away from cables 254 in all directions. Body 306 can include clamps 312 and 314 at opposite ends of slit 310 one-half way around its circumference. These clamps would either be connected to body 306 or clamp a portion of body 306 to cables 254 when tightened down. Clamps 312 and 314 can be separated or opened to be inserted over cables 254, such as is known in the art, and include closure members 316 and 318 to securely clamp them in place.

Therefore, abrasion reducing means 298 reduces the risk of damage to the cables along sometimes tens or even hundreds of feet lengths of pole 222. They can be spaced apart as desired and will absorb any shock of the cable traveling towards the interior sidewall of pole 222, or prevent cable 254 from abutting the interior of pole 222.

Normally, one will be positioned two feet below the top of pole top 224, and spaced apart thereafter as desired. FIG. 33 shows a top view along line 33—33 of FIG. 32. In this embodiment, body 306 substantially fills the space between cables 254 and the interior of pole 222.

FIG. 34 is an enlarged isolated perspective view of the brackets used for the quick mounting of ballast boxes 242, 244, and 246. Receiving and locating bracket 320 is attached to pole 222 by means known within the art. One example would be welling. Alternatively, it could be bolted. Bracket 322, on the other hand, is secured to the back of each ballast box by bolts, welding, or other means known within the art.

Bracket 322 includes a base portion 324 which is attached to the ballast box, and two opposite arms 326 and 328 which extend outwardly away from the base, and then laterally parallel to the back of the ballast box. At the outermost end of arms 326 and 328 is a pin or bolt 330 extending between and secured in that position by means known within the art. Basically, bracket 322 extends the laterally positioned pin 330 to a spaced apart position from the back of the ballast box and above the top of the ballast box. This allows persons to manually move the ballast box to a position adjacent bracket 320 on the pole, and to be able to visually see placement of pin 330 to guide it into the bracket 320.

Bracket 320 consists of two parallel arms 332 and 334. At the lower end of arms 332 and 334 are extensions 336 and 338 which extend at first outwardly and then upwardly. A bar 340 then connects these outer ends of extensions 336 and 338.

The side profile of each arm 332 and 334 is identical. An edge surface 342 exists which forms a rail or bearing surface for pin 330 of bracket 322 to be guided and slide along, when pin 330 is brought into abutment with bracket 320. Edge surface 342 has a first portion 344, a second curved portion 346, and a third flat or straight portion 348 that are above from bar 340. A fourth portion 350, lower or recessed from the first through third portions, terminates in a curved cradle portion which then extends backwardly and parallely in a fifth portion 354. It should be understood that the width between arms 332 and 334 is less than the width between arms 326 and 328 so that pin 330 can rest on both rails or edges 342 of arms 332 and 334, respectively.

FIGS. 35–40 show the sequence of operations to install a ballast box upon a pole utilizing brackets 320 and 322. FIG. 35 shows in solid lines the initial lifting and presentation of ballast box 242 and bracket 322 to bracket 320 on pole 222. The dashed lines illustrate that the next step would be to lower ballast box 242 vertically downwardly so that pin 330 passes above bar 340 and comes to a resting position on the third portions 348 of edge surfaces 342 of arms 332 and 334.

FIG. 36 (by arrow 356) illustrates the movement to that position. Thereafter, as illustrated by arrow 356, ballast box 242 is moved laterally backwards so that pin 330 slides and drops down on the fourth portion 350 of edge surfaces 342 back and then until it hits curved cradle portions 352 to lock pin 330 in place.

FIG. 37 shows in solid lines ballast box 242 in this position. As can be further seen in FIG. 38, when pin 330 is in this position, ballast box 242 is pivoted upwardly, but is basically located because pin 330 is held in the cradle portions of bracket 322.

As has been previously described, ballast box 242 includes an aperture 361 towards its end opposite from bracket 322 which ultimately will mate to conduit 358 which is secured to pole 222. Because it is difficult to accurately perform this step, brackets 320 and 322 make this much easier by again locating ballast box 342 in the pivoted position shown in FIGS. 37 and 38. All that needs to be done, as shown in FIGS. 37 and 38, is to pivot ballast box 242 downwardly (see arrow) towards pole 222. Location of conduit 358 into the aperture and ballast box 242 is therefore virtually automatic.

FIGS. 39 and 40 therefore show the ballast box 242 located with pin 330 of bracket 322 in bracket 320, and pivoted downwardly onto conduit 358. The insertion of conduit 358 into the embossed aperture 361 in ballast box 242 would prevent movement of ballast box along the axis of pole 222. The cradling of pin 330 in bracket 320 prevents lift off between brackets 320 and 322. Additionally, by securing means, conduit 358 is secured to ballast box 242 to prevent lift off of that end of ballast box 242. As can be appreciated, once pole 222 is brought to vertical, the gravitational weight of the ballast box will eliminate the risk of pin 330 sliding upwardly and outwardly from bracket 320.

It can therefore be seen that this special structure allows the ballast boxes to be quickly and easily installed onto pole 222 with a minimum of difficulty. These types of ballast boxes can weigh several hundred pounds. Previously the connection of conduit 358 to an opening in the back of ballast box 242 had to be by estimation because the connection could not easily be directly viewed. This was very difficult. The present invention eliminates these problems.

Figure 41:
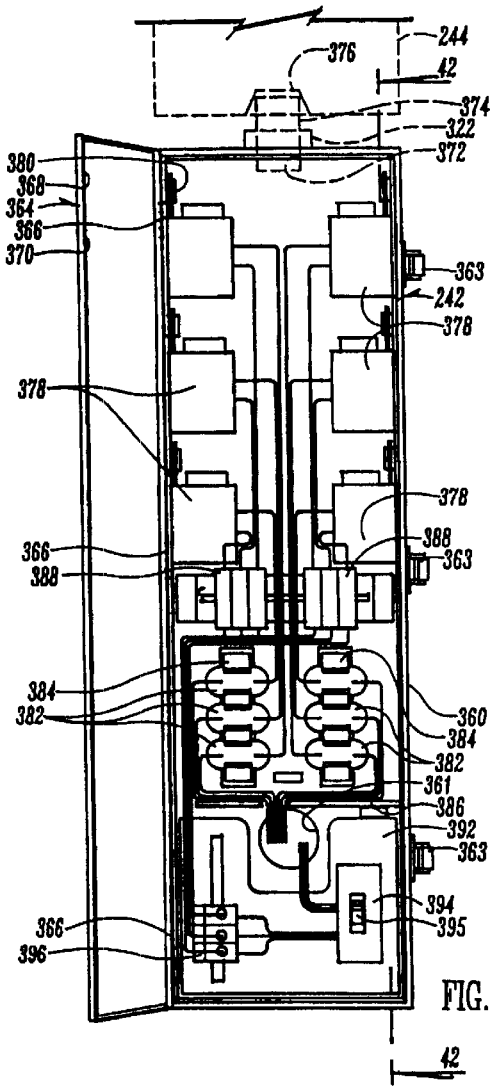
FIG. 41 is an enlarged front elevational view of a ballast box and its contents according to the present invention.
Figure 42:
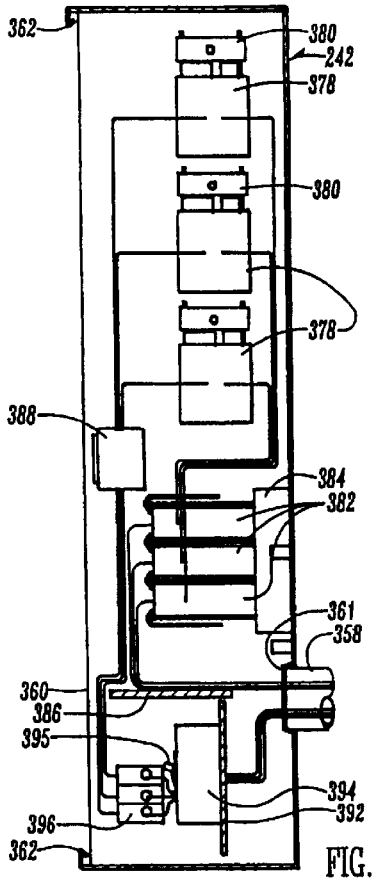
FIG. 42 is a sectional view taken along line 42—42 of FIG. 41.

FIGS. 41 and 42 depict contents of the interior of ballast box 242 according to the invention. A housing 360, of basically rectangular shape has an open front side which is bounded by a formed edge 362 (see FIG. 42). A door 364 is attached to housing 360 by a standard hinge 366 along one side. Door 364 also has a formed edge 368 around its perimeter and includes a gasket or insulation strip 370 to seal and insulate the area between edges 362 and 368 when the door is closed upon housing 360. This assists in keeping out moisture and the elements from the interior of ballast box 242. Lockable clasps 363 can be positioned on housing 360 to sealingly lock door 364 to housing 360.

FIGS. 41 and 42 also illustrate the stackability of additional ballast box 244 on top of ballast box 242. Basically, this is accomplished by opening an aperture 372 in the top of housing 360, and securing a conduit 374 in place in that aperture. An embossed or recessed opening 376 exists in ballast box 244 in its bottom wall.

As can be easily understood by referring back to the discussion of how each ballast box is attachable to pole 222, upper ballast box 244 can be located in its attachment bracket and then slid longitudinally downward so that opening 376 in the bottom of ballast box 244 seats upon conduit 374 of ballast box 242. Again, the gravitational weight of box 244 will hold it. basically in position once the pole is put to vertical. If desired, however, connection means can be utilized between the top of conduit 374 and ballast box 244 to further secure it in position.

As is understood, additional ballast boxes can then be stacked successively above ballast box 244 utilizing the brackets and openings and conduits previously discussed. Totally enclosed communication of wiring between boxes can then be accomplished through these components. It also still requires only one opening in pole 222 to communicate with any and all ballast boxes.

By still referring to FIGS. 41 and 42, the general arrangement of electrical components inside ballast box 242 is seen. In the upper portion of housing 360, ballasts 378 are positioned on the brackets 380. Lower inside housing 360 are capacitors 382 attached to the interior of housing 360 by brackets 384.

A dividing wall 386 exists underneath the capacitor and capacitor brackets to divide the interior of housing 360 into upper and lower compartments. A fuse block 388 can exist in the lower compartment under dividing wall 386. Additionally, opening 361 in communication with conduit 358 enters into this lower portion of housing 360 underneath dividing wall 386.

Still further, a vertical wall 392 (see FIG. 42) is positioned in the middle of the lower portion of housing 360. Thermomagnetic circuit breakers 394 can be attached to the front of this vertical wall, as can what are called landing lugs. These components are available from a variety of vendors and are standard components. The advantage of placement of these components in this particular structure is as follows.

Dividing wall 386 which extends substantially across housing 360 provides a thermal barrier between the upper and lower chambers of housing 360. Additionally, placement of circuit breakers 394 inside ballast 242 provides easily accessible power disconnect means (on/off switch 395) right at ballast box 242. In some conventional setups, the power disconnect must be accomplished at a remote location from the pole, which is inconvenient.

Still further, each of the electrical components has easy to mount standardized brackets which allows easy assembly of the ballast box at the factory. It also provides for flexibility as far as the number of components used (for example the number of ballast boxes is related to the number of light fixtures for the pole). Still further, it involves ease of maintenance.

Finally, this arrangement again enables substantial prewiring of the components at the factory, to eliminate that need on-site.

The only substantial connections that need to be made would be between the wiring or cabling coming from the connection to the electrical power source to circuit breakers 394 and landing lugs 396. These components have to be able to handle the types of cables ordinarily used for this electricity and must be able to handle high voltage, high current cabling.

Still further, the connections for these components are such that they are set up for virtually any conceivably needed arrangement. For example, sometimes three phase electrical power is needed, sometimes single phase. The landing lugs and circuit breaker connections are such that all it requires is for the installer to know which type of electricity is being used, and insert the leads into the premarked locations. This eliminates the risk of improper installation while allowing the flexibility to use either type of electrical power.

Figure 43:
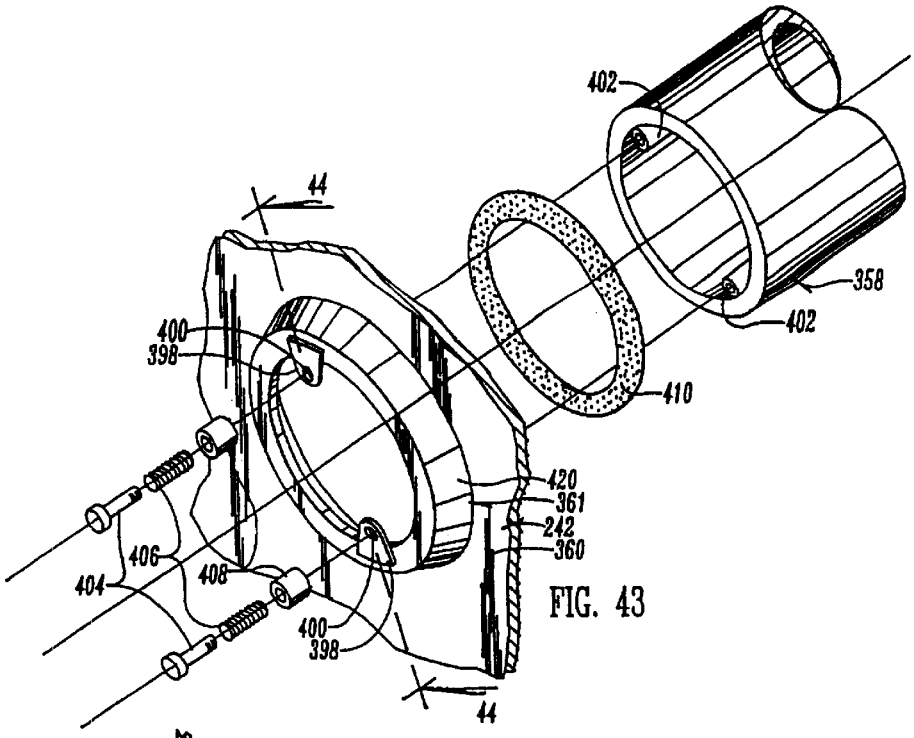
FIG. 43 is an isolated exploded view of a hub or conduit, and method of attachment of the conduit, of a pole to a ballast box according to the present invention.
Figure 44:
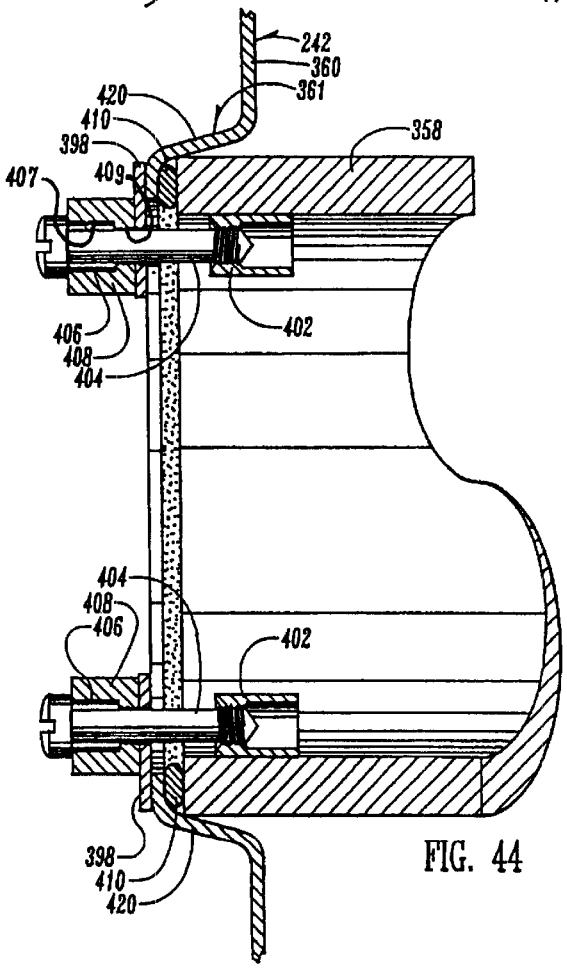
FIG. 44 is an enlarged sectional view taken along line 44—44 of FIG. 43.
Figure 45:
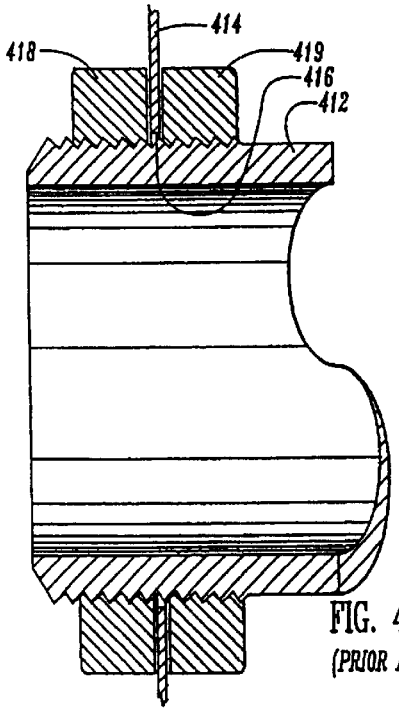
FIG. 45 (PRIOR ART)
FIG. 45 is a sectional depiction of a prior art method of attaching a conduit between a ballast box and the interior of a pole. The view is similar to that of FIG. 44 for comparison.

FIGS. 43–45 refer to the specific means utilized to secure the conduit 358 communicating with the interior of pole 222 with ballast box 242. As can be seen in FIG. 43, the embossed portion 420 around aperture 361 in the back of ballast box 242 includes tabs 398 which extend from basically opposite sides into opening 361 and have holes 400 at their outer ends.

Threaded receivers 402 are positioned in the interior outer end of conduit 358 in alignment with tabs 398. As shown in FIG. 43, screws 404 are insertable through springs 406, washers 408, and holes 400 in tabs 398, and then can be tightened into receivers 402 in conduit 358 when conduit 358 is brought in to embossed opening 361. As can be additionally seen, an O-ring 410, basically conforming to the end of conduit 358 and fitting within embossed opening 361, will form a seal to deter moisture or water from entering that joint. Springs 406 perform a biasing force to hold screws 404 in place.

FIG. 44 shows in cross section the arrangement when all components are fastened together. In particular, it is noted that springs 406 are captured in washers 408 in enlarged portions 407 of bores 409. The invention therefore provides a non-threaded junction which is sealed.

For purposes of comparison of the improvement of this combination, FIG. 45 shows one prior art method of attaching the conduit 412 between a pole and a ballast box 414. The exterior of conduit 412 is partially threaded. The entire conduit 412 can be inserted through an opening 416 in ballast box 414. Threaded nuts 418 and 419 are then moved towards one another on opposite sides of the wall of ballast box 414 around opening 416 to hold these components in place.

A prime deficiency and problem with this arrangement is the requirement of the threads on the exterior of conduit 412. To attempt to weather proof these components, which are generally metal, the metal must be galvanized. The galvanization usually enters the threads making the connection extremely difficult. It is hard to accurately turn the nuts 418 and 419 on the threaded conduit 412 to reliable and secure connection. Sometimes the threads must be retapped. The combination of FIGS. 43 and 44 eliminates these problems and provides the weather-tight seal.

Figure 46:
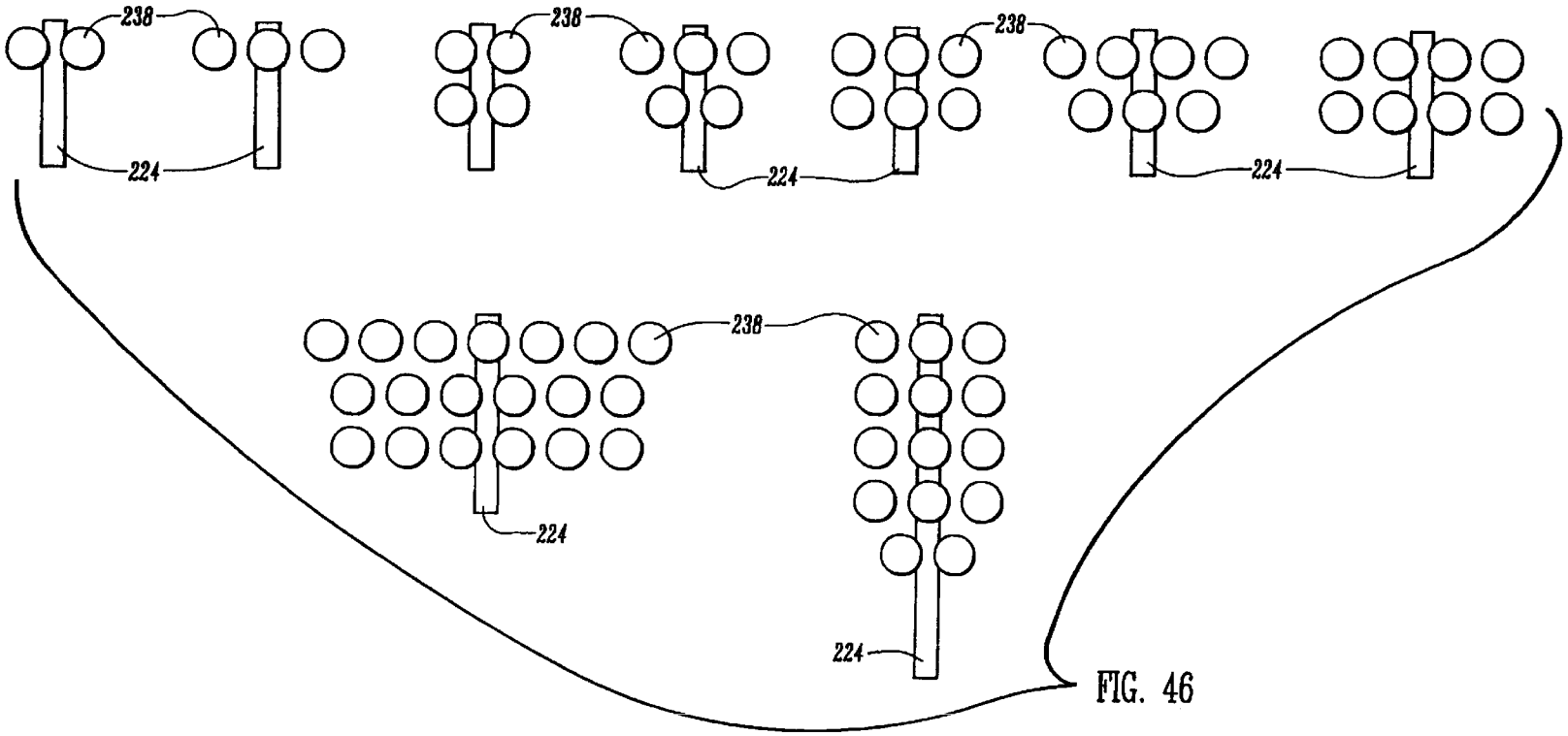
FIG. 46 is a graphical depiction of a variety of different lighting fixture configurations that can be utilized with the pole top member according to the present invention.

FIG. 46 schematically depicts examples of the tremendous flexibility of design of the present invention. In particular, it shows how pole top 224 can be predesigned and manufactured to support a variety of numbers of lighting fixtures 238 in a variety of configurations. Moreover, it shows how the dimensions of any of those arrangements can be constricted to fit within limitations for shipping these entire assemblies preassembled. By way of example, the arrangements carrying 2 through 8 fixtures are no more than five feet wide from top to bottom. The arrangement carrying 19 fixtures is no more than eight feet from top to bottom. The arrangement carrying 15 fixtures is no more than five feet from side to side. The numbers on each of these configurations corresponds with the number of fixtures that are attached to them. Any of these combinations can be shipped in standard semi-trailers.

Figure 47:
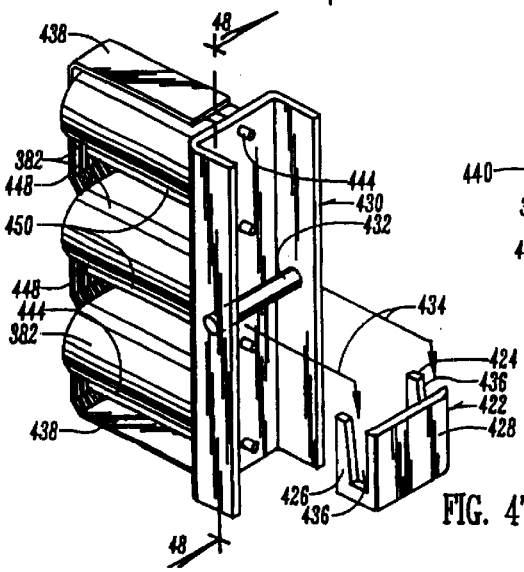
FIG. 47 is a perspective view of capacitors and a capacitor mounting bracket assembly according to the present invention.
Figure 48:
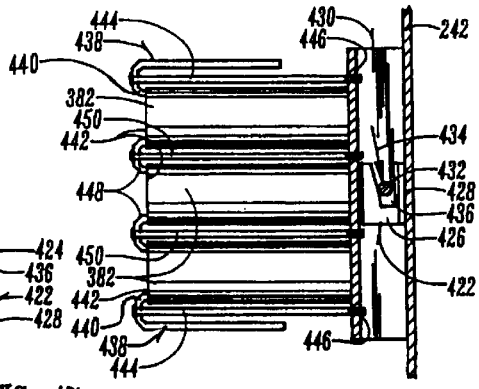
FIG. 48 is a sectional view taken along line 48—48 of FIG. 47.

FIGS. 47 and 48 depict an advantageous bracketing structure for mounting capacitors 382 to the interior of ballast box 242. As can be seen in FIG. 47, a receiving bracket 422 having L-shaped legs 424 and 426 is attached on its back surface 428 to the interior side wall of ballast box 242.

A U-shaped channel piece 430 has a pin 432 extending transversely across the interior of the channel as shown. Capacitors 382 are attached to the opposite side of channel piece 430. Once secured in position, pin 432, as shown by arrows 434, is moved and dropped into slots 436 between legs 424 and 426, and back surface 428. The weight of channel piece 430 and attached capacitors 382 holds channel piece 430 in receiving bracket 422.

FIG. 48 shows in more detail how capacitors 382 are connected to channel piece 430. J-shaped pieces 438 are positioned so that their hook ends 440 grasp lip 442 on each capacitor 382. A bolt 444 extends through an aperture in hook end 440 and extends along the side of capacitors 382 to a threaded aperture 446 in channel piece 430. Also, C-shaped members 448 grasp around lips 442 of adjacent capacitors 382, shown in FIG. 48, and bolts 450 extend through apertures in members 448 back to threaded apertures 446 and U-shaped channel piece 430. This arrangement holds capacitors 382 against U-shaped piece 430 in an economical but secure manner. The entire assembly of capacitors 382 and channel piece 430 can be easily removed for replacement or servicing.

Note also that slots 436 are narrower in diameter from top to bottom, as shown in FIG. 48. Therefore, pin 432 actually cams down into frictional fit within slots 362 and adds security to that fit. However, it is not difficult to remove the entire assembly.

This arrangement therefore provides an easily assemblable and economical way to mount capacitors within the ballast box.

It can therefore be seen that the individual structural components of the preferred embodiment of the invention allow wide and advantageous flexibility with regard to design, manufacturing, supply, insulation, operation, and maintenance of the invention. This must be kept in mind when considering the practical operation of the invention. By "operation", it is intended to mean all of the above mentioned steps and processes involved with the invention beginning with the design of the components for the particular installation, and ending with its maintenance.

In operation, information as to the particular location and application for each lighting installation is obtained. Such things as pole height, number of lighting fixtures, direction of aiming of fixtures, and the like are gathered. This type of information then can be analyzed to determine such things as the number and types of ballast boxes, the length of cabling, and the number of cross bars needed or desired.

It should further be understood that this analysis is not merely limited to each single lighting installation comprising a pole and a number of fixtures. It is many times also analyzed with a view towards the position and combination with other lighting installations at the same site. Thus, this further illustrates how the comprehensive and integrated approach can result in better or more efficient composite lighting of a location, which all ties in with the improved functionality and economy of the present invention.

At this early design stage, it can therefore be seen that the light fixtures and their function, the pole and its functions, and the electronics and its functions are taken into consideration. The present invention allows this sort of integrated planning by the manufacturer or vendor of the installations. It should not go unnoticed that the flexibility of the invention also allows the customer to request certain configurations, whether for aesthetic purposes, or otherwise, which may be accommodated by these designs.

Manufacturing of the components can also be analyzed and integrated into each customized installation in the sense that the components are so flexibly and easily assembled that custom manufacturing is greatly reduced. Also, it is emphasized that the particular types of components of the invention reduce the associated hardware and parts needed to assemble the final installation. For example, no bracket mounting hardware is needed for the cross arms. No significant hardware is needed for securing the different pole sections together. Openings in bolt holes for mounting such things as light fixtures are premanufactured. Cabling channels are preplanned and premanufactured. Again, this applies to both the light fixtures and their mounting means, the pole and cross bars and base, and various other electrical components.

Still further, the invention allows the production of such things as precise lengths of cabling, provision of abrasion resistant means, electrical connectors, and prewiring of a substantial amount of the same at the factory. It is again emphasized that in custom installations as presently conducted, the cabling has to be laid and then cut, then electricians need to make the connections. Any attempts at precutting the cabling risks the cabling being too long or too short.

With regard to supply and shipping of the integrated components for an installation, as previously described, the flexibility of the invention allows substantial preassembly at the factory and then shipping by economical conventional means to location. For example, as previously discussed in detail, a pole top member 224 with fixed cross arms 234 and 236 can have the desired number of fixtures attached at the factory and prewired so that all that is required is to install the pole top on top of the pole and plug in the prewired cabling to the remaining cabling for the installation. The fixtures can be aimed according to predesigned directions, as has been previously explained in patents of the present inventors. Specifically, although these installations utilize substantially large light fixtures for lighting wide scale areas such as athletic fields, the preassembled pole top array with fixtures can normally be shipped in a semi-trailer, which has significant limitations with respect to width or height, when dealing with this large of an object. The pole can be shipped in sections as can other components, including concrete premanufactured bases. Therefore, a number of installations can be partially preassembled at the factory, placed on one semi-trailer, and shipped directly on site. There is no requirement of switching freight carriers, as is sometimes a problem with one piece long poles which do not fit on semi-trailers.

The invention also allows virtually the entire installation to be at least partially preassembled at the factory in the sense that even the electrical components, some of which are obtained from other manufacturers, can be installed at the factory. The installation can be virtually pre-programmed and prepackaged at the factory. Much of the matrix discussed previously can now be completed at the factory. This eliminates quite a bit of the dependence on the contractors on-site. An example of this would be the contents of the ballast boxes which can be shipped and easily installed without the need of substantial assembly on site.

With regard to installation of lights, pole, and electronics, as has been previously discussed, the present invention greatly reduces time, labor, and effort required. Essentially, once the bases 212 are sufficiently set in the ground, it is a matter of unloading the components, adjusting the lighting fixtures 238 into the preselected aiming angles from the fixed cross arms 234 and 236, installing the desired number of pole sections and pole top together, installing ballast boxes as needed, and connecting up the electrical connections. The pole is then raised and slip fitted onto the base. Any adjustments as far as rotational direction can be made, and finally the electrical connections to the electrical power source are made completing the installation. This should be directly compared to the problems discussed with regard to erecting poles such as are known in the prior art, then assembling the cross bars and fixtures, and finally preparing the electrical components and wiring.

It can be appreciated that the advantages of the invention also apply to the use and operation of each installation. The pole structure has improved resistance to corrosion add space, it can be made from materials such as steel which is desirable. The fixed cross arms on the top pole provide a ready made unchangeable reference coordinate system for the aiming of the light fixtures. The abrasion reducing means and abrasion resistant sheaths, cable grip, and prewiring increase the reliability and durability of the wiring. The optional connections of the ballast boxes also furthers this goal.

Overall, although the installation is quick and economical, it has high reliability and durability.

Maintenance likewise is improved in that the ballast boxes are easily accessible, and yet are secure and shielded from water and the elements. The reliability of the wiring and the mechanical structure reduces the chances of required maintenance. Features such as built in ears or tabs allow the attachment of maintenance equipment and these considerations can be analyzed from the very beginning design of the installation.

It can therefore be seen that the base according to one embodiment of the invention, comprised of the prestressed, precast concrete, can be plumbed in a bore in the ground, and then concrete can be poured around the base to effectively increase its size. Since the concrete only needs to have compressive strengths, it can set up quickly. The whole process then ensures the base is plumb and secure for any type of hole it needs to support.

This ties in with the ability then to be ensured that the top of the pole will also be directly vertically above the base. As previously described, this allows the design of the system to be prepacked and shipped to the installation site. The entire unit can then be installed. It is virtually then reassembled on cite as a composite, integrated, unitary installation according to the predesign parameters.

The most efficient utilization of the lighting fixtures can therefore be preplanned at the factory and integrated with other lighting fixtures and poles for the particular location. All of the fixtures can then be reliably predesigned to provide an efficient composite photometric beam. The lighting fixtures, no matter how many, can basically be designed as a part of the pole structure. They can be quickly installed so that the entire array of fixtures on each pole can then be quickly aimed to create the smooth, efficient, composite beam. The field or area to be lighted can be predefined to have an orthogonal coordinate system. The poles and light fixtures can therefore accurately be predicted as to where they will exist in that coordinate system to make this composite beam in lighting possible.

Still further, it is disability to reliably predict the position of the fixtures prior to installation, that allows other needed components for the lighting installation such as ballast, capacitors, wiring, etc., to be predesigned and at least partially preassembled and sized at the factory. This in turn allows for a quick economical and easy installation on site which is of very important economic value.

It can furthermore be seen that the present invention allows the utilization of a straight pipe for center piece 226 of pole top 224, as seen in FIG. 30. By methods known in the art, the bottom end 228 can be tapered by flaring it so that it can be integrated with the tapered upper end 230 of pole 222. It is to be understood that pole top center piece 226 would cost almost ten times as much if it had to be prefabricated in a tapered fashion.

It will therefore be appreciated that the present invention can take many forms and embodiments. The present preferred embodiment is in no way intended to limit the scope thereof which is defined solely by the claims set forth below.

For example, various of the components can be utilized separately from the other components with advantageous results. The quick attach ballast boxes, the pole structure, the pole top member, the abrasion resistant devices, and preconfigured wiring are examples of just a few.

The ballast boxes can be mounted at any location around the perimeter of the pole. Sometimes they are preferred to be in back of the pole.

Additionally, these various advantageous features can be used in any combination with one another that is reasonable and desired.

What is claimed is:

1. A combination of tall pole and cross arms for elevating a plurality of large wattage light fixtures, which is partially pre-assembled and pre-wired, then conveniently shipped, and then completely pre-assembled and pre-wired prior to erection at the location of installation of the pole in the ground, comprising:

a base including a lower portion adapted for insertion and anchoring in the ground or to other supporting structure and an upper portion having an outside diameter;

a hollow pole shipable in one or more sections, having a top with an upper open end and a bottom with a lower open end, which is mateably slip-fittable over at least a portion of the upper section of the base;

a plurality of lighting fixtures mounted to one or more cross arms;

a pole top including an elongated hollow vertical portion which is mateably slip fittable over the top of the pole, a hollow extension extending laterally from the elongated hollow vertical portion to each fixed cross arm, interior passageways in each cross arm communicating with openings at spaced apart positions in each cross arm defining attachment locations for the plurality of lighting fixtures;

pre-wired cables between lighting fixtures and the hollow section, the pre-wired cables terminating in a header which is accessible through an opening in the top pole which is sealable by a removable cover member;

pre-sized cables having a connection to said header and a length to extend from said header through the interior of the pole to in the vicinity of the base when the apparatus is assembled;

adjustable connection mounts between the attachment locations on each cross arm and the lighting fixtures to allow pre-assembly of lighting fixtures to each cross arm and pre-aiming of lighting fixtures prior to shipping, and final pre-aiming once at the installation location;

slip fit joints between any pole sections and between said pole top and the top of the pole to allow final assembly of the tall pole with the pole top and fixtures on the ground at the assembly location, with pre-wired cables extending in the hollow pole, and including a component for securing the cables in place in the pole, a component for deterring abrasion of the cables with the interior of the pole and a second header to electrically connect said cables to the header the pole top, to complete pre-wiring from the fixtures to at or near the bottom of the pole when the pole and pole top are on the ground;

a ballast box with a mounting bracket;

a bracket on the exterior near the bottom of the pole to allow mounting of the ballast box to the bracket on the pole when the pole is on the ground, the brackets including a receiver member on the pole means and a capture member near the top of the ballast box, to allow securement of the top end of the ballast box to the pole, the pole having an opening and a hollow connecting piece space apart from and below the receiver which mates into a receiving opening near the lower end of the ballast box;

internal pre-wiring between pre-assembled electrical components in the ballast box, including multiple ballasts for the plurality of light fixtures, in the ballast box, and connectors to connect up with the cables in the pole; and a connection in the ballast box for quick connection to service lines to electrically connect the electrical circuitry of the pole to an electrical power source so that the pre-assembled tall pole can then be erected onto said base in the ground, with all light fixtures pre-assembled, pre-aimed, and pre-wired to a ballast box and electrical power source.

2. The apparatus of claim 1 wherein the pole has a tapered bottom end for slip fitting to a tapered top end of the pole section.

3. The apparatus of claim 1 wherein the cross arms are extended out in front of the pole top.

4. The apparatus of claim 1 including light fixtures having mounting brackets which can be oriented with respect to the position of the cross arms to the pole top and to predetermined aiming directions.

5. The apparatus of claim 1 wherein the brackets on the exterior of the pole include a receiving section for receiving a locating member attached to the ballast box to automatically position a portion of the ballast box with respect to the pole, and a securing section to allow the ballast box to be generally secured at the location of the locating member to the pole but being pivotable on the securing section.

6. The apparatus of claim 5 wherein the ballast box included an aperture which is mateable over an extension conduit surrounding an aperture in the pole when the ballast box is pivoted on the securing section to a position adjacent the pole to allow electrical wiring in the pole section to communicate with electrical wiring in the interior of the ballast box.

7. The apparatus of claim 1 further comprising a plurality of ballast boxes and brackets for mounting the plurality of ballast boxes to the exterior of the pole section.

8. A method of assembling an integrated light pole and electrical components for hollow metal light poles elevating a plurality of large wattage light fixtures, but allowing substantial pre-assembly prior to erection and installation, and allowing shipping by over the road transportation vehicles, comprising:

determining the location for the light pole and the plurality of light fixtures to be elevated by the light pole;

determining the desired height of the light pole at that location;

positioning an upper portion of a base above the ground when a lower portion of the base is positioned in the ground, mateably slip fitting the bottom of the pole over the upper section of the base;

slip fitting a hollow pole top to the top of the pole before erection, the pole top including one or more hollow cross arms to which are mounted a plurality pre-aimed, pre-wired lighting fixtures;

pre-wiring the pole top prior to insertion on top of the pole by electrically connecting the lighting fixtures to a wiring harness in the pole top;

extending pre-configured, pre-sized wiring through the interior of the pole and connecting the preconfigured, pre-sized wiring to the wiring harness in the pole top;

mounting at least one ballast box to quick attach brackets on the exterior of the pole a predetermined distance up the pole, but away from the top of the pole;

pre-wiring the electronic components of each ballast box prior to mounting the ballast box, the quick attach brackets including one member which cooperates with a component at one end of the ballast box to allow pivotable movement of an opposite end of the ballast box towards an opening in the pole;

adding abrasion resistance members to the wiring through the pole top and the pole;

securing the wiring at a location in the pole top; and erecting the combined pole and pole top onto the base secured in the ground at the location, so that pre-wiring and pre-assembly is completed before erection to eliminate the need for wiring, assembly, or fixture aiming once the pole is erected yet having durable protection of wiring.

9. The method of claim 8 wherein the base is made of reinforced concrete.

10. The method of claim 8 wherein the pole is made of tubular metal.

11. The method of claim 8 comprising the step of matching the diameters and lengths of the base and pole according to desired strength, height, and weight of the pole and any structure attached to the pole.

12. The method of claim 8 further comprising constructing the pole of one or more pole sections, each having a opening in a bottom portion and in an upper portion, and being slip fittable sequentially to each preceding pole section.

13. The method of claim 12 further comprising the steps of: moving the base to a pre-excavated hole in the ground; adjusting the base so that it is generally plumb; filling the remaining areas of the excavated hole with a material to stabilize the base means in the hole; and slip fitting a first pole section to the base.

14. The method of claim 13 further comprising slip fitting one or more additional pole sections sequentially beginning with the first pole section.

15. The method of claim 8 further comprising:

determining the needs of the integrated light pole by considering one or more of the set comprised of height, weight, and distribution of the one or more light fixtures which are to be suspended, when loaded;

determining the needs of the base to support the pole by considering one or more of the set comprised of (a) desired pole, (b) type of ground, (c) type of mounting in the ground, and (d) stress at or around the base;

selecting a configuration for the pole from one or more of the set comprised of (a) number of sections of the pole, (b) shape of each section, (c) length of each section, (d) largest diameter each section, (e) sheet thickness and gauge of each section, (f) steel tensile strength of each section, and (g) type of steel of each section;

selecting a configuration of the base by considering one or more of the set comprising (a) the set used in selection the configuration of the pole, (b) diameter of the base, (c) amount of the base covered by the pole when connected, (d) type of concrete used in the base, (e) treatment of the concrete used the base and rebar structure used in the base, (f) wall thickness, (g) stress, (h) type of steel used with pole, (i) joint strength, (j) shipping considerations, (k) ground type, and (l) length of taper; and constructing a desired configuration of the base and pole according to the selected determinations.

16. A light pole for suspending multiple high wattage light fixtures having pre-wired electrical connections comprising:

a base with an entrance opening, a lower portion and an upper portion, the base being anchorable in and near the ground and through which wiring from an electrical power source is connectable to wiring in the base extending down form the light fixtures;

a pole member having a hollow interior channel mateably slip-fittable over at least a portion of the upper section of the base, the pole having an entrance opening along its side above but relatively near its lower end;

a top insert member mountable by slip fitting on top of the pole, the top insert member including extension members extending laterally from a side of and along the top insert member and cross bars connected at outer ends of the extension members generally perpendicularly to the top insert member, each cross bar having openings along its length adapted for connection of and communication to lighting fixtures; and channels through the base, pole, and top insert member for complete communication of pre-sized wires from an electrical power source to ballast boxes connected by brackets to the exterior of the pole at the opening along the pole, and to the fixtures connected to the cross bars.

17. The light pole of claim 16 wherein the pole is comprised of at least one section of predetermined height, the predetermined height being a predetermined interior length, the top, insert member, extension members, and cross bars having predetermined lengths through their interiors to the openings in the cross bars the base having a predetermined interior length, and a predetermined number of fixtures being connectable to the cross bars so that wiring length can be approximated and pre determined before installation of the pole.

18. The light pole of claim 16 further comprising abrasion resistance members connected at predetermined lengths along the wires through the length of the pole.

19. The light pole of claim 16 wherein the wires at least partially are twisted together and covered with an abrasion resistant material.

20. A method of installing in the ground light poles for suspending multiple high wattage light fixtures comprising;

determining the required height and strength of a tapered hollow steel pole supporting a plurality of said light fixtures in an elevated position;

manufacturing a pole with characteristics to match the determined height and strength, the characteristics including, but not limited to, diameter and thickness at top, bottom and locations there between;

manufacturing a base which is pre-stressed in design to accommodate the pole, the base having a tapered upper end upon which can be slip fit the tapered bottom end of the pole, the base having a height and a width;

creating a hole in the ground which has a predetermined depth and width correlated to the required volume and area to support the base and pole in a vertical orientation;

positioning the base in the hole;

plumbing the base; and backfilling concrete, which has compressive strength, in the hole to use the compressive strength to support the base in the hole.

* * * * *